US006908177B2

(12) United States Patent
Suganuma

(10) Patent No.: US 6,908,177 B2
(45) Date of Patent: Jun. 21, 2005

(54) ELECTROSTATIC EJECTION TYPE INK JET HEAD

(75) Inventor: Atsushi Suganuma, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 138 days.

(21) Appl. No.: 10/629,762

(22) Filed: Jul. 30, 2003

(65) Prior Publication Data

US 2004/0021738 A1 Feb. 5, 2004

(30) Foreign Application Priority Data

Jul. 30, 2002 (JP) ..... 2002-221274
Jul. 30, 2002 (JP) ..... 2002-221275

(51) Int. Cl.[7] ..... B41J 2/06
(52) U.S. Cl. ..... 347/55
(58) Field of Search ..... 347/9, 54, 55, 347/103, 111, 112, 120, 123, 127, 128; 399/273, 290, 293–295

(56) References Cited

U.S. PATENT DOCUMENTS 4,263,601 A 4/1981 Nishimura et al.
4,271,416 A 6/1981 Shimizu et al.
4,333,086 A 6/1982 Ebi
4,504,844 A * 3/1985 Ebi et al. ..... 347/55
4,510,509 A 4/1985 Horike et al.
4,737,803 A 4/1988 Fujimura et al.
5,144,340 A * 9/1992 Hotomi et al. ..... 347/55
6,092,889 A * 7/2000 Nakamoto et al. ..... 347/55
6,158,844 A 12/2000 Murakami et al.

FOREIGN PATENT DOCUMENTS

| | | |
|---|---|---|
| EP | 0 426 854 A1 | 5/1991 |
| EP | 0 836 943 A2 | 4/1998 |
| EP | 0 911 163 A1 | 4/1999 |
| JP | 54-97425 A | 8/1979 |
| JP | 09-239988 A | 9/1997 |
| JP | 10-23608 A | 9/1998 |

OTHER PUBLICATIONS

Patent Abstracts of Japan, abstracting JP–A–10–230608, published Sep. 2, 1998.

* cited by examiner

*Primary Examiner*—Stephen D. Meier
*Assistant Examiner*—An H. Do
(74) *Attorney, Agent, or Firm*—Sughrue Mion, PLLC

(57) ABSTRACT

An electrostatic ejection type ink jet head according to an embodiment of the present invention includes: first drive electrodes that are respectively provided for individual electrodes and are arranged closer to an insulating substrate side than an ink flow path; and a second drive electrode that is provided commonly among all of the individual electrodes and is arranged closer to a head substrate side than the first drive electrodes. At the time of recording of an image, ink ejection/non-ejection is controlled by biasing the second drive electrode to a predetermined voltage level having the same polarity as a fine particle component contained in ink and switching the first drive electrodes between a high-impedance state and a ground level in accordance with image data.

14 Claims, 14 Drawing Sheets

ELECTROSTATIC EJECTION TYPE INK JET HEAD

BACKGROUND OF THE INVENTION

1. Field of the Invention

The present invention relates to an electrostatic ejection type ink jet head that controls ejection of ink by means of an electrostatic force.

2. Description of the Prior Art

In an electrostatic ejection type ink jet recording system, ink containing a charged fine particle component is used and a predetermined voltage is applied to each individual electrode of an ink jet head in accordance with image data, thereby controlling ejection of the ink by means of an electrostatic force and recording an image corresponding to the image data on a recording medium. As a recording apparatus adopting this electrostatic ejection type ink jet recording system, an ink jet recording apparatus disclosed in JP 10-230608 A is known, for instance.

FIG. 21 is an example of a conceptual diagram showing a schematic construction of an ink jet head of the ink jet recording apparatus disclosed in the above patent document. In this drawing, an ink jet head 350 is shown as the ink jet head of the disclosed ink jet head recording apparatus, with only one of individual electrodes constituting the ink jet head being conceptually illustrated. Also, the ink jet head 350 includes a head substrate 312, an ink guide 314, an insulating substrate 316, a drive electrode 352, and a counter electrode 322.

Here, the ink guide 314 is arranged on the head substrate 312, and a slit serving as an ink guide groove 326 is formed in the center portion of the ink guide 314 in the top-bottom direction on the paper plane of this drawing. Also, in the insulating substrate 316, a through hole 328 is established at a position corresponding to an arrangement of the ink guide 314. The ink guide 314 is allowed to pass through the through hole 328 established in the insulating substrate 316 so that the tip portion thereof protrudes above the upper surface of the insulating substrate 316 in the drawing.

Also, the drive electrode 352 has a ring shape and is provided for each individual electrode on the upper surface of the insulating substrate 316 in the drawing so as to surround the periphery of the through hole 328 established in the insulating substrate 316. Further, the head substrate 312 and the insulating substrate 316 are arranged with a predetermined space therebetween, and an ink flow path 330 is formed between the substrates 312 and 316. Also, the counter electrode 322 is arranged at a position opposing the tip portion of the ink guide 314 and a recording medium P is placed on the lower surface of the counter electrode 322 in the drawing.

Also, FIG. 22 is an example of a conceptual construction diagram of a drive circuit for the drive electrode.

The drive circuit 354 in this drawing includes an FET (field-effect transistor) 334 and resistive elements 336 and 338. A drain of the FET 334 is connected to the drive electrode 352, a source of it is connected to ground level, and a gate of it receives input of a control signal. Also, the resistive element 336 is connected between a high-voltage power supply and the drive electrode 352, while the resistive element 338 is connected between the control signal and the ground level.

In the drive circuit 354, the control signal is changed between high level and low level in accordance with image data. When the control signal is set to the high level, the FET 334 is turned on and the drive electrode 352 becomes the ground level. On the other hand, when the control signal is set to the low level, the FET 334 is turned off and the drive electrode 352 becomes the high-voltage level of the high-voltage power supply. That is, the drive electrode 352 is frequently switched between the ground level and the high-voltage level in accordance with the image data.

At the time of recording, ink containing a fine particle component and charged to the same polarity as the high-voltage level applied to the drive electrode 352 is circulated in a direction from the right to the left in FIG. 18.

When the drive electrode 352 is set as the ground level, the electric field strength in proximity to the tip portion of the ink guide 314 is reduced, and therefore, the ink will not fly out from the tip portion of the ink guide 314. In that case, a part of the ink moves upward along the ink guide groove 326 formed in the ink guide 314 due to capillary action until above the upper surface of the insulating substrate 316 in the drawing.

On the other hand, when the high-voltage level is applied to the drive electrode 352, the ink that moved upward along the ink guide groove 326 of the ink guide 314 until above the upper surface of the insulating substrate 316 in the drawing flies out from the tip portion of the ink guide 314 due to a repulsion force. The ink is then attracted to the counter electrode 322 biased to a negative voltage level and adheres onto the recording medium P.

The ink jet head 350 and the recording medium P placed on the counter electrode 322 are relatively moved during this operation, thereby recording an image corresponding to the image data on the recording medium P.

By the way, when a recording apparatus is required to perform high-definition recording at high speed, a line head that is capable of recording one line of an image at a time inevitably becomes necessary. When the definition and recording speed of the recording apparatus are respectively 1200 dpi (dot/inch) and 60 ppm (page/minute), for instance, a line head that is capable of recording an image on a recording medium having a width of 10 inch needs to include many individual electrodes, whose number is 12000 that is equal to the number of pixels on one line, and drive circuits whose number is equal to the number of the individual electrodes to be driven.

In this case, the individual electrodes and the drive circuits need to be implemented in the line head at a physically extremely high density with reference to the line direction. The drive circuits use high voltage (around 600 V, for instance), so that when the individual electrodes and the drive circuits are arranged at a high density, a danger of discharge is increased. Accordingly, it is extremely difficult to cope with both high-density implementation and high-voltage operation.

Also, in the drive circuits described above, if it is assumed that current of 1 mA flows to each individual electrode, the total current flowing to the 12000 individual electrodes becomes up to 12 A. Accordingly, when switching to high voltage of 600 V is performed, the power consumption becomes 7.2 kW. Even if an efficiency of the high-voltage power supply is assumed 100%, a power source of AC 200 V and 36 A is required. Even in that case, only the recording of a monochrome image on an A4-size recording medium is possible, which means that such a system is too much unrealistic.

When a FET is used to perform the switching like the drive circuit described above, it is principally required to flow a certain current to the FET in order to maintain switching speed. In contrast to this, the drive electrode is so minute ring-shaped electrode that the amount of a current consumed by ink ejection itself is around 50 nA at most and is extremely small. That is, most of the current supplied from the high-voltage power supply is consumed by the switching of the FET.

SUMMARY OF THE INVENTION

The present invention has been made in order to solve the above problems in the prior art, and an object thereof is to provide an electrostatic ejection type ink jet head that is capable of performing high-definition recording at high speed without increasing power consumption.

Another object of the present invention also is to provide an electrostatic ejection type ink jet head that is capable of performing smooth circulation of ink through an ink flow path in proximity to an ink guide.

In order to attention the object described above, the invention provides an electrostatic ejection type ink jet head that uses ink containing a charged fine particle component, controls ejection/non-ejection of the ink by means of an electrostatic force by applying a predetermined voltage to individual electrodes in accordance with image data, and records an image corresponding to the image data on a recording medium, the electrostatic ejection type ink jet head comprising a head substrate, first drive electrodes provided for each of the individual electrodes, a second drive electrode provided commonly among all of the individual electrodes, ink guides arranged on the head substrate for each of the individual electrodes, and an insulating substrate in which through holes are established for each of the individual electrodes at a position corresponding to an arrangement of the ink guides, wherein the head substrate and the insulating substrate are arranged with a predetermined space therebetween, a flow path of the ink is formed between the head substrate and the insulating substrate, the ink guides are passed through the through holes established in the insulating substrate, tip portion of the ink guides are protruded above a surface of the insulating substrate on a recording medium side, the first drive electrodes are arranged closer to the insulating substrate side than the flow path of the ink, and the second drive electrode is arranged closer to the head substrate side than the first drive electrodes, and at the time of recording of the image, ejection/non-ejection of the ink is controlled by biasing the second drive electrode to a predetermined voltage level having the same polarity as the fine particle component contained in the ink and switching the first drive electrodes between a high-impedance state and a ground level in accordance with the image data.

Also, in order to attain the object described above, the invention provides an electrostatic ejection type ink jet head that uses ink containing a charged fine particle component, controls ejection/non-ejection of the ink by means of an electrostatic force by applying a predetermined voltage to a plurality of individual electrodes arranged in a two-dimensional manner with reference to a first direction and a second direction in accordance with image data, and records an image corresponding to the image data on a recording medium, the electrostatic ejection type ink jet head comprising a head substrate, first drive electrodes and second drive electrodes provided for each of the individual electrodes to form a two-layered electrode structure, ink guides arranged on the head substrate for each of the individual electrodes, and an insulating substrate in which through holes are established for each of the individual electrodes at a position corresponding to an arrangement of the ink guide, wherein the head substrate and the insulating substrate are arranged with a predetermined space therebetween, a flow path of the ink is formed between the head substrate and the insulating substrate, the ink guides are passed through the through holes established in the insulating substrate, tip portion of the ink guides are protruded above a surface of the insulating substrate on a recording medium side, the first drive electrodes are arranged closer to the insulating substrate side than the flow path of the ink, the second drive electrodes are arranged closer to the head substrate than the first drive electrodes, the first drive electrodes on each line of the plurality of individual electrodes arranged in the first direction are connected mutually, and the second drive electrodes on each line of the plurality of individual electrodes arranged in the second direction are connected mutually, and wherein the ejection/non-ejection of the ink at the time of recording of the image is controlled by sequentially repeating one of an operation (i) in which the second drive electrodes on all lines of the individual electrodes in the second direction are set to a high voltage level or a ground level in accordance with the image data under a state where the first drive electrodes on one line of the individual electrodes in the first direction are set under a high-impedance state and the first drive electrodes on all remaining lines of the individual electrodes in the first direction are set to a ground level while sequentially changing the first drive electrodes on the line of the individual electrodes in the first direction that are set under the high-impedance state, and an operation (ii) in which the first drive electrodes on all lines of the individual electrodes in the first direction are set to a high-voltage level or the ground level in accordance with the image data under a state where the second drive electrodes on one line of the individual electrodes in the second direction are set under the high-impedance state and the second drive electrodes on all remaining lines of the individual electrodes in the second direction are set to the ground level while sequentially changing the second drive electrodes on the line of the individual electrodes in the second direction that are set under the high-impedance state.

Also, in order to attain the object described above, the invention provides an electrostatic ejection type ink jet head that uses ink containing a charged fine particle component, controls ejection/non-ejection of the ink by means of an electrostatic force by applying a predetermined voltage to a plurality of individual electrodes arranged in a two-dimensional manner with reference to a first direction and a second direction in accordance with image data, and records an image corresponding to the image data on a recording medium, the electrostatic ejection type ink jet head comprising a head substrate, first drive electrodes and second drive electrodes each provided for each of the individual electrodes to form a two-layered electrode structure, ink guides arranged on the head substrate for each of the individual electrodes, and an insulating substrate in which through holes are established for each of the individual electrodes at a position corresponding to an arrangement of the ink guide, wherein the head substrate and the insulating substrate are arranged with a predetermined space therebetween, a flow path of the ink is formed between the head substrate and the insulating substrate, the ink guides are passed through the through holes established in the insulating substrate, tip portion of the ink guides are protruded above a surface of the insulating substrate on a recording medium side, the first drive electrodes are arranged closer to the insulating substrate than the flow path of the ink, the second drive electrodes are arranged closer to the head substrate side than the first drive electrodes, the first drive electrodes on each line of the plurality of individual electrodes arranged in the first direction are connected mutually, and the second drive electrodes on each line of the plurality of individual electrodes arranged in the second direction are connected mutually, and ejection/non-ejection of the ink at the time of recording of the image is controlled by sequentially repeating one of an operation (i) in which the second drive electrodes on all lines of the individual electrodes in the second direction are turned on or off in accordance with the image data under a state where the first drive electrodes on one line of the individual electrodes in the first direction are turned on and the first drive electrodes on all remaining lines of the individual electrodes in the first direction are turned off while sequentially changing the first drive electrodes on the line of the individual electrodes in the first direction that are turned on, and an operation (ii) in which the first drive electrodes on all lines of the individual electrodes in the first direction are turned on or off in accordance with the image data under a state where the second drive electrodes on one line of the individual electrodes in the second direction are turned on and the second drive electrodes on all remaining lines of the individual electrodes in the second direction are turned off while sequentially changing the second drive electrodes on the line of the individual electrodes in the second direction that are turned on, with the operation (i) being performed under a state where the individual electrodes are arranged so that the number of lines of the individual electrodes in the second direction is larger than the number of lines thereof in the first direction and the operation (ii) being performed under a state where the individual electrodes are arranged so that the number of lines in the first direction is larger than a number of lines in the second direction.

Also, in order to attain the object described above, the invention provides an electrostatic ejection type ink jet head that uses ink containing a charged fine particle component, controls ejection/non-ejection of the ink by means of an electrostatic force by applying a predetermined voltage to a plurality of individual electrodes arranged in a two-dimensional manner with reference to a first direction and a second direction in accordance with image data, and records an image corresponding to the image data on a recording medium, the electrostatic ejection type ink jet head comprising a head substrate, first drive electrodes and second drive electrodes each provided for each of the individual electrodes to form a two-layered electrode structure, ink guides arranged on the head substrate for each of the individual electrodes, and an insulating substrate in which through holes are established for each of the individual electrodes at a position corresponding to an arrangement of the ink guide, wherein the head substrate and the insulating substrate are arranged with a predetermined space therebetween, a flow path of the ink is formed between the head substrate and the insulating substrate, the ink guides are passed through the through holes established in the insulating substrate, tip portion of the ink guides are protruded above a surface of the insulating substrate on a recording medium side, the first drive electrodes are arranged closer to the insulating substrate than the flow path of the ink, the second drive electrodes are arranged closer to the head substrate side than the first drive electrodes, the first drive electrodes on each line of the plurality of individual electrodes arranged in the first direction are connected mutually, the second drive electrodes on the line of the plurality of individual electrodes arranged in the second direction are connected mutually, and the lines of the individual electrodes in the first direction are divided into a plurality of groups that each group contains at least one line, and ejection/non-ejection of the ink at the time of recording of the image is controlled by simultaneously for the plurality of groups and sequentially repeating one of an operation (i) in which the second drive electrodes on all lines of the individual electrodes in the second direction are turned on or off in accordance with the image data under a state where the first drive electrodes on one line of the individual electrodes in the first direction are turned on and the first drive electrodes on all remaining lines of the individual electrodes in the first direction are turned off while sequentially changing the first drive electrodes on the line of the individual electrodes in the first direction that are turned on, and an operation (ii) in which the first drive electrodes on all lines of the individual electrodes in the first direction are turned on or off in accordance with the image data under a state where the second drive electrodes on one line of the individual electrodes in the second direction are turned on and the second drive electrodes on all remaining lines of the individual electrodes in the second direction are turned off while sequentially changing the second drive electrodes on the line of the individual electrodes in the second direction that are turned on.

Also, in order to attain another object described above, the invention provides an electrostatic ejection type ink jet head that performs recording by ejecting ink containing charged fine particles by means of an electrostatic force, comprising a head substrate, an insulating substrate arranged so as to be spaced from the head substrate by a certain distance and forms an ink flow path in a space with the head substrate, an ink guide arranged on the head substrate so that tip portion thereof protrudes from a through hole established in the insulating substrate, and guides the ink flowing through the ink flow path from the ink flow path to the tip portion, a drive electrode provided for a part of an inner wall of the ink flow path side of the insulating substrate in proximity to the ink guide so as to surround a periphery of the ink guide, and is used to eject the ink guided to the tip portion of the ink guide by means of the electrostatic force, and a coating film coating the drive electrode and smoothing the inner wall of the ink flow path side.

BRIEF DESCRIPTION OF THE DRAWINGS

Preferred embodiments of the present invention will be described in detail based on the following figures, wherein.

DETAILED DESCRIPTION OF THE PREFERRED EMBODIMENTS

Hereinafter, an electrostatic ejection type ink jet head according to the present invention will now be described in detail based on referred embodiments shown in the accompanying drawings.

Figure 1A:
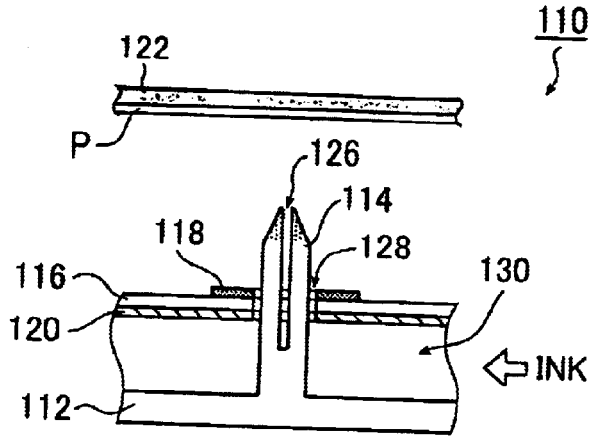
FIGS. 1A and 1B are respectively a conceptual construction diagram and a schematic perspective view of an electrostatic ejection type ink jet head according to a embodiment of the present invention.
Figure 1B:
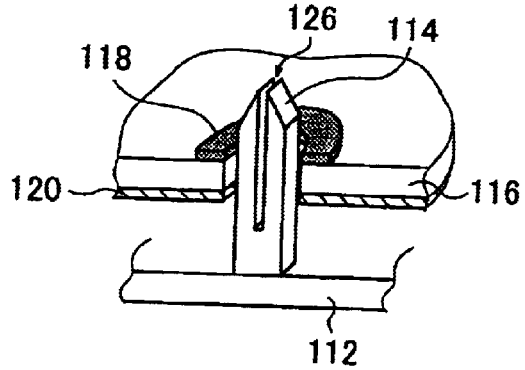

FIGS. 1A and 1B are respectively a conceptual construction diagram and a schematic perspective view of an electrostatic ejection type ink jet head according to an embodiment of the present invention. The electrostatic ejection type ink jet head 110 shown in those drawings records an image corresponding to image data on a recording medium P by ejecting ink containing a charged fine particle component, such as a pigment, by means of an electrostatic force. The electrostatic ejection type ink jet head 110 includes a head substrate 112, an ink guide 114, an insulating substrate 116, a first drive electrode 118, a second drive electrode 120, and a counter electrode 122.

It should be noted here that in FIGS. 1A and 1B, only one of individual electrodes constituting the ink jet head 110 is conceptually illustrated. The number of the individual electrodes is not specifically limited so long as at least one individual electrode is used, and the physical arrangement and the like of the individual electrode are not specifically limited. For instance, it is also possible to construct a line head by arranging multiple individual electrodes in a one-dimensional or two-dimensional manner. Also, the ink jet head of this embodiment is ready for both of monochrome recording and color recording.

In the ink jet head 110 of the illustrated example, the ink guide 114 is arranged on the head substrate 112 for each individual electrode, and a slit serving as an ink guide groove 126 is formed in a center portion of the ink guide 114 in a top-bottom direction on the paper plane of the drawings. Also, in the insulating substrate 116, a through hole 128 is established at a position corresponding to the arrangement of the ink guide 114. The ink guide 114 passes through the through hole 128 established in the insulating substrate 116 so that the tip portion thereof protrudes above the upper surface of the insulating substrate 116 in the drawing.

It should be noted here that the tip portion of the ink guide 114 is formed to an approximately triangular shape (or a trapezoidal shape) that is gradually narrowed toward the counter electrode 122 side, and a metal is evaporated onto the extreme tip portion thereof from which the ink is to be ejected. Although this metal evaporation is not indispensable but preferable because the dielectric constant in the extreme tip portion of the ink guide 114 becomes substantially infinite and there is produced an effect that it becomes easy to cause a strong electric field. Note that the shape of the ink guide 114 may be changed as appropriate.

The head substrate 112 and the insulating substrate 116 are arranged with a predetermined space therebetween, and an ink flow path 130 is formed between the substrates 112 and 116. Also, the counter electrode 122 is arranged at a position opposing the tip portion of the ink guide 114, and a recording medium P is placed on the lower surface of the counter electrode 122 in the drawing. At the time of recording, the counter electrode 122 is constantly biased to a negative voltage level having an opposite polarity of the high voltage applied to the second drive electrode 120.

Also, the first drive electrode 118 has a ring shape and is provided for each individual electrode on the upper surface of the insulating substrate 116 in the drawing so as to surround the periphery of the through hole 128 established in the insulating substrate 116. Further, the second drive electrode 120 has a sheet shape and is provided commonly among all individual electrodes on the lower surface of the insulating substrate 116 in the drawing except for each region in which the through hole 128 has been established in the insulating substrate 116, and is constantly biased to a high voltage level at the time of recording.

Figure 2:
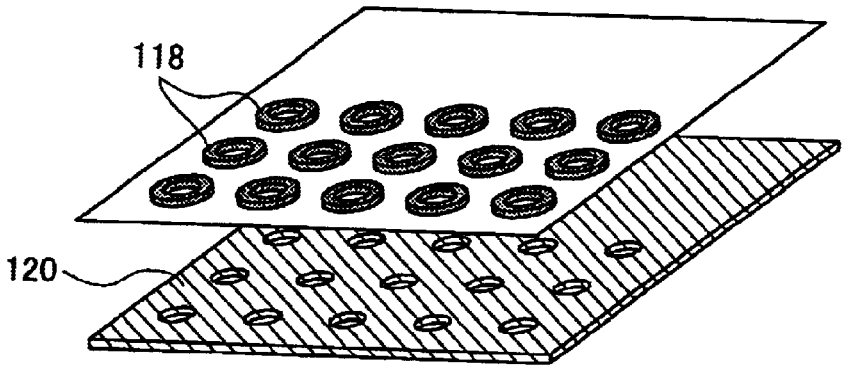
FIG. 2 is a conceptual construction diagram showing an arrangement of drive electrodes in the electrostatic ejection type ink jet head according to the embodiment of the present invention.

When the ink jet head 110 includes 15 individual electrodes as shown in FIG. 2, for instance, three rows of the individual electrodes are formed with each row including five individual electrodes. In the ink jet head 110, ink ejection/non-ejection is controlled by the first drive electrodes 118 and the second drive electrode 120. Note that in the ink jet head 110 of this embodiment, a two-layered electrode structure formed by the first drive electrodes 118 and the second drive electrode 120 is used, but the present invention is not limited to this, and the drive electrodes having any other electrode structure of so long as at least two layers may be used.

Next, arrangements of the first drive electrodes 118 and the second drive electrode 120 will be described.

The first drive electrodes 118 need to be arranged closer to the insulating substrate 116 side than the ink flow path 130. Also, the second drive electrode 120 needs to be arranged closer to the head substrate 112 side than the first drive electrodes 118. When the first drive electrodes 118 are arranged on the upper surface of the insulating substrate 116 in the drawing, for instance, there may be adopted arrangement shown in FIG. 3A in which the second drive electrode 120 is arranged on the lower surface side of the insulating substrate 116 in the drawing or arrangement shown in FIG. 3B in which the second drive electrode 120 is arranged inside of the head substrate 112.

Also, there may be provided, commonly among all individual electrodes, an electrophoretic electrode that has a sheet shape and is biased to a voltage level having the same polarity as the fine particle component contained in the ink and energizes the fine particle component toward the insulating substrate 116 side at the time of image recording. This electrophoretic electrode needs to be arranged closer to the head substrate 112 side than the ink flow path 130. Also, it is preferable that the electrophoretic electrode is arranged on the upstream side of the ink flow path 130 with reference to the position of the individual electrode. With this electrophoretic electrode, it becomes possible to maintain the fine particle component contained in ejected ink at a predetermined concentration.

Figure 3A:
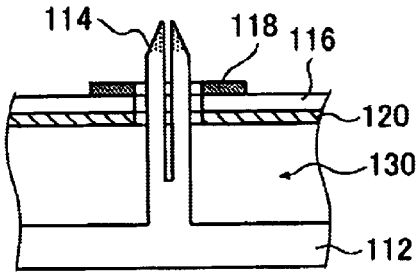
FIGS. 3A, 3B, 3C, and 3D are conceptual diagrams showing variations of arrangements of a first drive electrode, a second drive electrode, and an electrophoretic electrode of the electrostatic ejection type ink jet head according to the embodiment of the present invention.
Figure 3B:
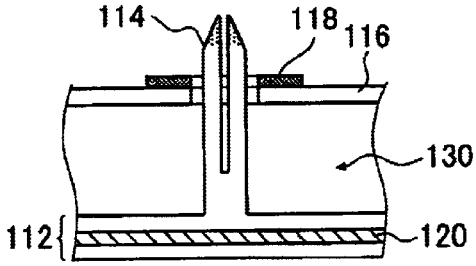
Figure 3C:
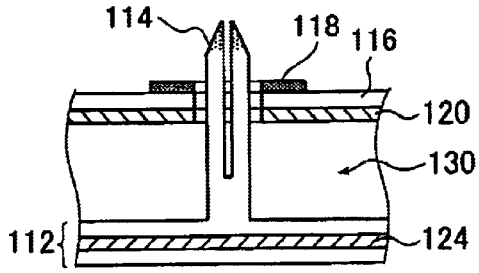
Figure 3D:
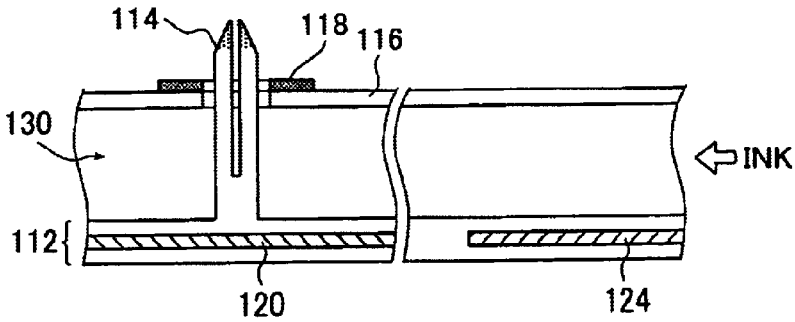

When the electrophoretic electrode is provided under a state where the first drive electrode 118 and the second drive electrode 120 are arranged in the manner shown in FIG. 3A, the electrophoretic electrode 124 may be arranged inside of the head substrate 112 as shown in FIG. 3C. Also, when the first drive electrode 118 and the second drive electrode 120 are arranged in the manner shown in FIG. 3B, the electrophoretic electrode 124 may be arranged inside of the head substrate 112 on the upstream side of the ink path flow 130 with reference to the position of the individual electrode as shown in FIG. 3D.

It should be noted here that the arrangement of the first drive electrode 118, the second drive electrode 120, and the electrophoretic electrode 124 is not specifically limited so long as the mutual positional relationships described above are satisfied. For instance, the first drive electrode 118 and the second drive electrode 120 may be arranged on the upper surface and the lower surface of the insulating substrate 116 in the drawing, or both or either of the electrodes 118 and 120 may be arranged inside of the insulating substrate 116. Also, the second drive electrode 120 and the electrophoretic electrode 124 may be arranged on the upper surface or the lower surface of the head substrate 112 in the drawing or be arranged inside thereof.

Next, a drive circuit for the first drive electrode 118 shown in FIGS. 1A and 1B will be described.

Figure 4:
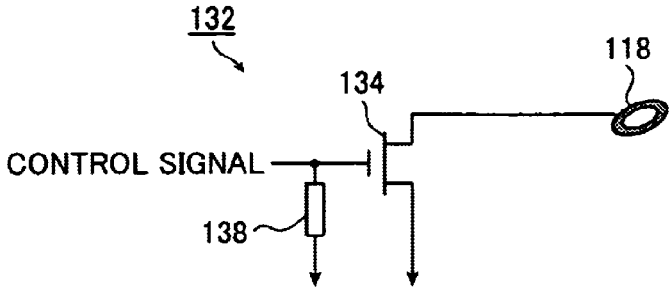
FIG. 4 is a conceptual construction diagram of a drive circuit for the first drive electrode of the electrostatic ejection type ink jet head according to the embodiment of the present invention.

FIG. 4 is an embodiment of a conceptual construction diagram of the drive circuit for the first drive electrode.

The drive circuit 132 shown in this drawing includes an open-drain type FET (field-effect transistor) 134 and a resistive element 138. The drain of the FET 134 is connected to the first drive electrode 118, the source of it is connected to the ground, and the gate of it receives input of a control signal. Also, the resistive element 138 is connected between the control signal and the ground.

In the drive circuit 132, the control signal is changed between the high level and the low level in accordance with image data. When the control signal is set to the high level, the FET 134 is turned on and the first drive electrode 118 becomes the ground level. On the other hand, when the control signal is set to the low level, the FET 134 is turned off and the first drive electrode 118 is placed under a high-impedance (floating) state. That is, the first drive electrode 118 is switched between the ground level and the high-impedance state in accordance with the image data.

It should be noted here that the drive circuit is not limited to the construction of the illustrated example, and any other circuit construction may be used so long as it is possible to switch the potential of the first drive electrode 118 between the ground level and the high-impedance state. Also, in this embodiment, the FET 134 is used as a switching element, but the present invention is not limited to this, and any other conventionally known switching element such as a bipolar transistor may be used.

Next, an operation of the ink jet head 110 of this embodiment will be described.

In the ink jet head 110 of the illustrated example, ink containing a fine particle component, such as a pigment, and charged to the same polarity as the high-voltage level applied to the second drive electrode 120 is circulated by a not-shown pump or the like inside of the ink flow path 130 in a direction from the right to the left in FIGS. 1A and 1B at the time of recording.

Figure 5A:
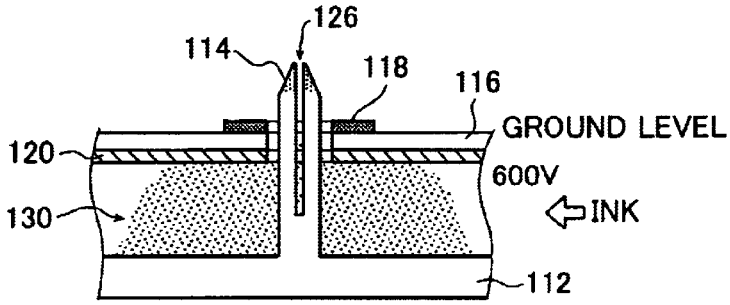
FIG. 5A is a conceptual diagram showing a state at the time of ink non-ejection of the electrostatic ejection type ink jet head according to the embodiment of the present invention.

As shown in FIG. 5A, in a case that the second drive electrode 120 is constantly biased to 600 V, for instance, the electric field strength in proximity to the tip portion of the ink guide 114 is low when the first drive electrode 118 is set to the ground level, so that the ink does not fly out from the tip portion of the ink guide 114. In this case, a part of the ink moves upward along the ink guide groove 126 formed in the ink guide 114 due to capillary action until above the lower surface of the insulating substrate 116 in the drawing.

Figure 5B:
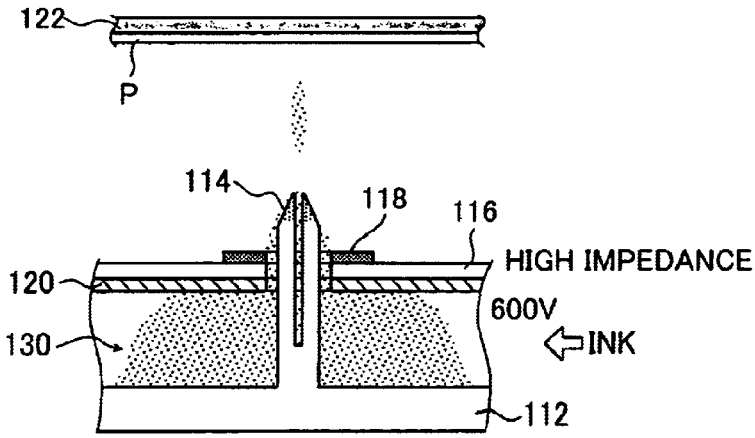
FIG. 5B is a conceptual diagram showing a state at the time of ink ejection of the electrostatic ejection type ink jet head according to the embodiment of the present invention.

On the other hand, when the first drive electrode 118 is set to the high impedance as shown in FIG. 5B, the electric field strength in proximity to the tip portion of the ink guide 114 is increased. At that time the ink which moved upward along the ink guide groove 126 of the ink guide 114 until above the lower surface of the insulating substrate 116 in FIGS. 1A and 1B flies out from the tip portion of the ink guide 114 due to a repulsion force. The ink is then attracted to the counter electrode 122 that is biased to −1.5 kV or the like, and adheres onto the recording medium P.

In other words, the high voltage constantly applied to the second drive electrode 120 needs to be set to a voltage with which when the first drive electrode 118 is placed under a ground level state, the electric field strength in the tip portion of the ink guide 114 becomes an electric field strength with which the ink will not fly out (non-ejection) from the tip portion of the ink guide 114, and when the first drive electrode 118 is placed under the high-impedance state, the electric field strength in the tip portion becomes an electric field strength with which the ink will fly out (ejection) from the tip portion of the ink guide 114.

The ink jet head 110 and the recording medium P placed on the counter electrode 122 are relatively moved during the operation described above, thereby recording an image corresponding to the image data on the recording medium P.

In the ink jet head 110 of this embodiment, switching to the high voltage is not performed by the FET 134 at the time of recording, so that there will never be consumed a large electric power by the switching of the FET 134. Accordingly, even in an ink jet head that is required to perform high-definition recording at high speed, it becomes possible to significantly reduce power consumption. Also, even when the individual electrodes and the drive circuit are implemented at a physically extremely high density, there is almost no danger that discharge may occur, so that it becomes possible to cope with both the high-density implementation and the high-voltage operation with safety.

Figure 6A:
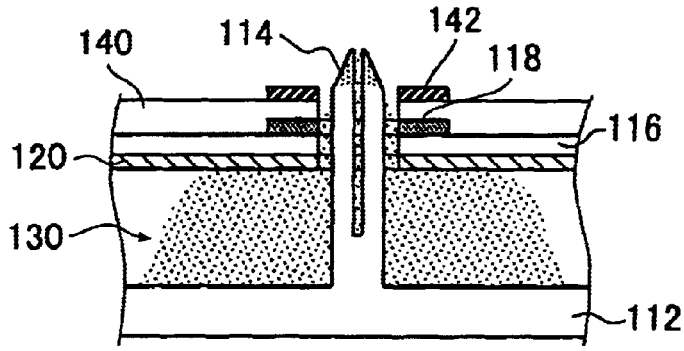
FIGS. 6A and 6B are conceptual construction diagrams of the electrostatic ejection type ink jet head according to another embodiment of the present invention.

It should be noted here that a two-layered electrode structure was described in the above embodiment, but three or more-layered electrode structure may be used as described above. For instance, as shown in FIG. 6A, a second insulating substrate 140 that is the same as the insulating substrate 116 may be provided on the upper surface of the first drive electrode 118 in the drawing, and a third drive electrode 142 may also be provided commonly in a sheet shape among all individual electrodes on the upper surface of the second insulating substrate 140 in the drawing. To this third drive electrode 142, a negative voltage level (around −100 V, for instance) is constantly applied at the time of recording. Note that the third drive electrode 142 may be arranged closer to the recording medium P side than the first drive electrode 118.

With this construction, it becomes easy to generate an electric field with which the ink will not fly out from the tip portion of the ink guide 114. Also, an effect that it becomes possible to provide an electric field that reaches the recording medium P with stability is achieved.

Figure 6B:
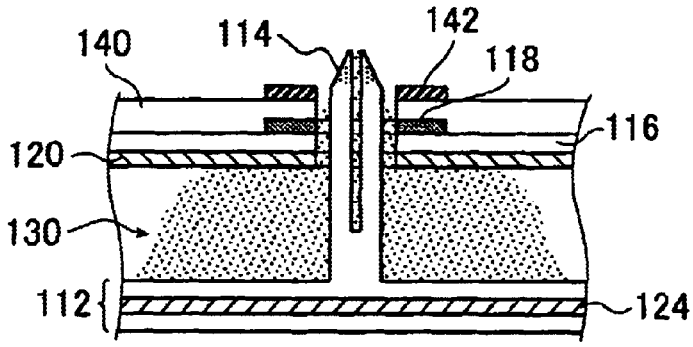

Also, as shown in FIG. 6B, in the ink jet head shown in FIG. 6A, an electrophoretic electrode 124 may be further arranged inside of the head substrate 112 at a position corresponding to arrangement of each individual electrode. To this electrophoretic electrode 124, a voltage level (around 400V, for instance) is constantly applied at the time of recording. Note that it is sufficient that the electrophoretic electrode 124 is arranged closer to the head substrate 112 side than the ink flow path 130.

With this construction in which there are used the first drive electrode 118, the second drive electrode 120, and the third drive electrode 142, it becomes possible to reduce the drive voltage applied to each individual electrode. In addition, with the electrophoretic electrode 124, the charged fine particle component is condensed in proximity to the first to third drive electrodes, so that an effect, which is possible to control the ejection of the ink with efficiency while reducing the overall power consumption of the ink jet head, is produced.

Hereinafter, the result of an ink ejection experiment actually conducted using an ink jet head according to the present invention will be described.

Figure 7:
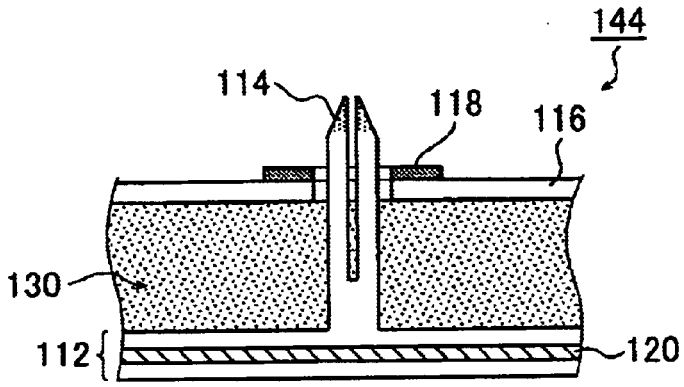
FIG. 7 is a conceptual construction diagram of the electrostatic ejection type ink jet head according to the embodiment of the present invention with which an ink ejection experiment was conducted.

The ink ejection experiment was conducted using an ink jet head 144 shown in FIG. 7. This ink jet head 144 has a construction where the electrophoretic electrode 124 is eliminated from the ink jet head 110 shown in FIGS. 1A and 1B, and the second drive electrode 120 is arranged inside of the head substrate 112. The ink ejection experiment was conducted under a condition where the second drive electrode 120 was biased to 400 V and the counter electrode was biased to −1.5 kV.

It was confirmed that under the condition described above, ink was not ejected when the first drive electrode 118 was set as the ground level and was ejected when the first drive electrode 118 was set to the high-impedance state. That is, it was confirmed that it was principally possible to eject the ink using the two-layered electrode structure of the present invention.

Figure 8A:
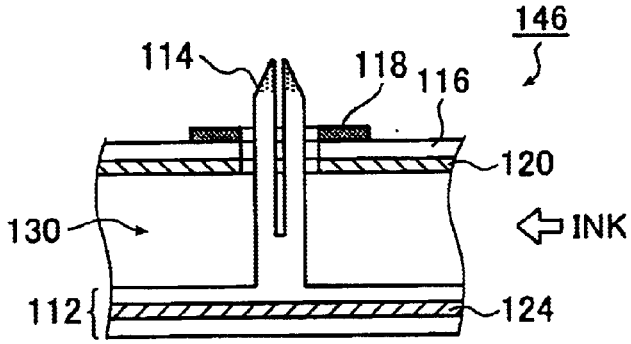
FIG. 8A is an example of a conceptual construction diagram of the electrostatic ejection type ink jet head.
Figure 8B:
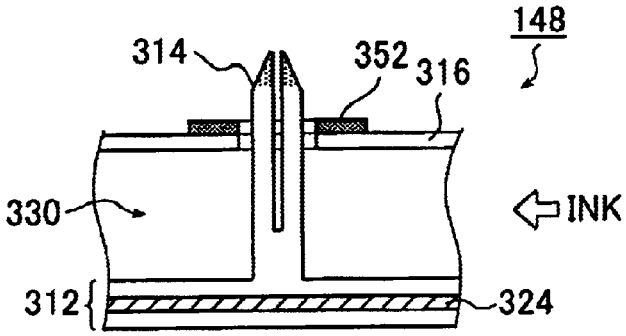
FIG. 8B is an example of a conceptual construction diagram of a conventional electrostatic ejection type ink jet head.
Figure 21:
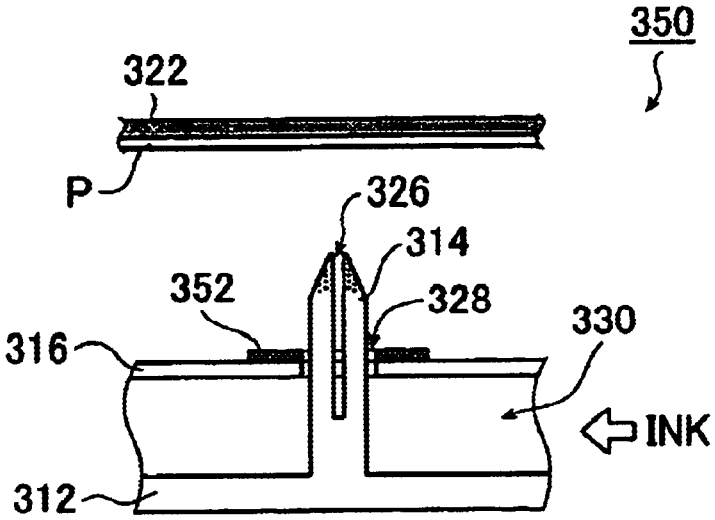
FIG. 21 PRIOR ART
FIG. 21 is an example of a conceptual construction diagram of the conventional electrostatic ejection type ink jet head.
Figure 22:
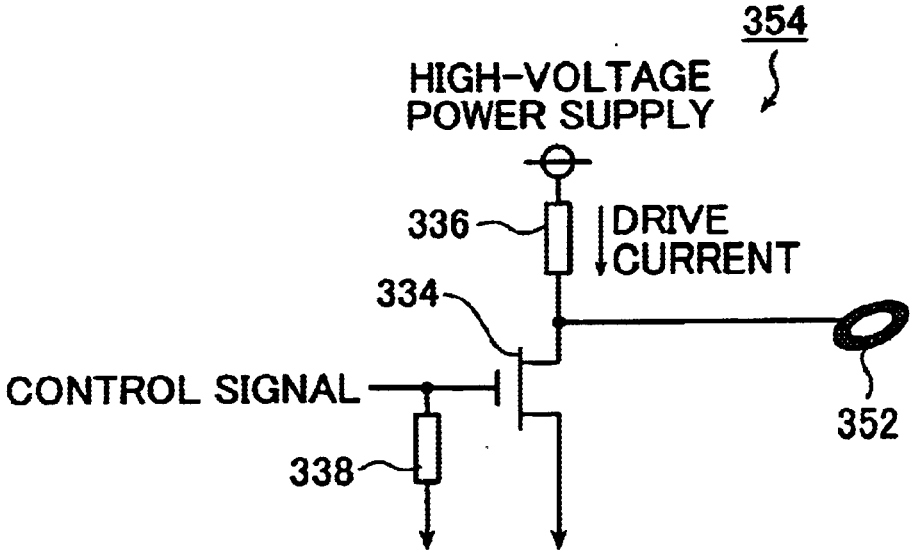
FIG. 22 PRIOR ART
FIG. 22 is an example of a conceptual construction diagram of a drive circuit for an individual electrode of the conventional electrostatic ejection type ink jet head.

Also, as to each of an ink jet head 146 shown in FIG. 8A according to the present invention and a conventional ink jet head 148 shown in FIG. 8B, the distribution of an electrostatic field in proximity to the tip portions of the ink guides 114 and 314 were analyzed through simulation. The ink jet head 146 has a construction where the electrophoretic electrode 124 is further provided in the head substrate 112 of the ink jet head 110 shown in FIGS. 1A and 1B, and the ink jet head 148 has a structure where the electrophoretic electrode 324 is further provided in the head substrate 112 of the ink jet head 350 shown in FIG. 21.

When analyzing the electrostatic field distribution, the voltage level of the counter electrodes 122 and 322 were set to −1.5 kV, and the voltage level of the electrophoretic electrodes 124 and 324 were set to 400 V. Also, in the ink jet head 146 according to the present invention, the voltage level of the second drive electrode 120 was set to 600 V and the first drive electrode 118 was switched between the high-impedance state and the ground level. On the other hand, in the conventional ink jet head 148, the drive electrode 352 was switched between 400 V and the ground.

Figure 9A:
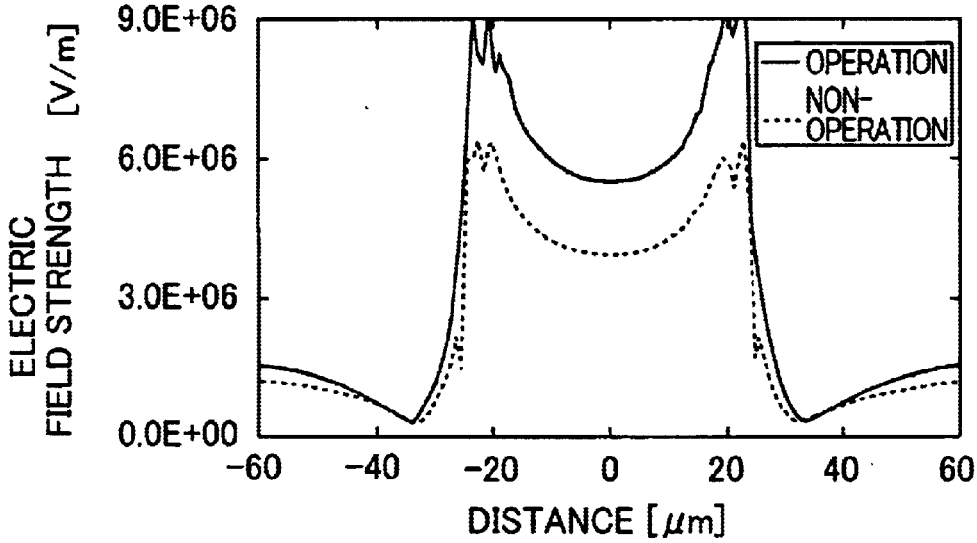
FIG. 9A is a graph showing a relationship between an electric field strength and a distance of the electrostatic ejection type ink jet head according to the embodiment of the present invention.
Figure 9B:
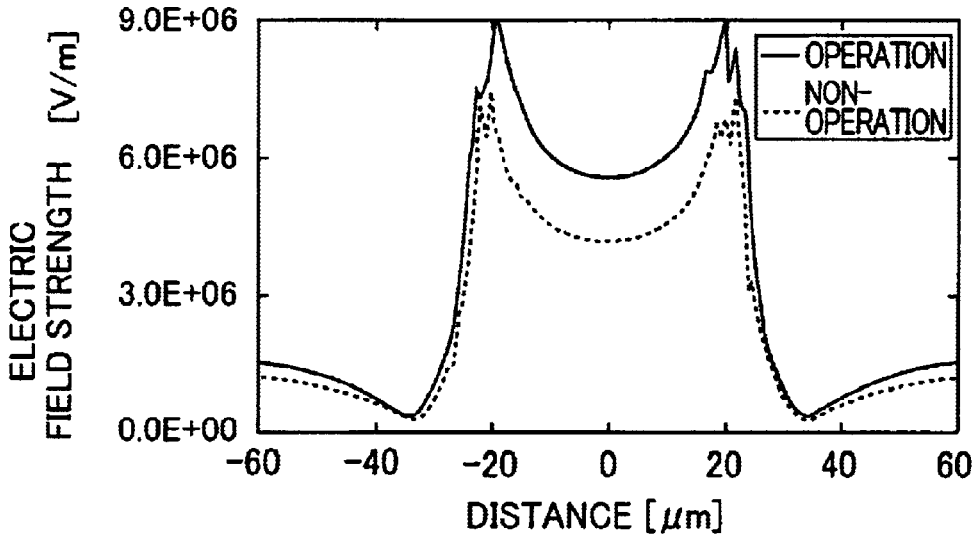
FIG. 9B is an example of a graph showing a relationship between an electric field strength and a distance of the conventional electrostatic ejection type ink jet head.

FIGS. 9A and 9B are graphs showing results of the analysis of the ink jet heads 146 and 148, respectively. In those graphs, the horizontal axis represents a distance (position) from the tip portions of the ink guides 114 and 314 in a horizontal direction in the drawing, while the vertical axis represents electric field strength at each position of the tip portions of the ink guides 114 and 314. Also, in these graphs, the solid line indicates a result of a relationship between the electric field strength and the distance at the time of ink ejection (operation), while the dotted line indicates a result of a relationship between the electric field strength and the distance at the time of ink non-ejection (non-operation).

The vertexes of two mountain portions in the graphs correspond to the positions of the vertexes of the triangular shape of the ink guides 114 and 314. As can be seen from these graphs, the width of the ink guide grooves 126 and 326 formed in the ink guides 114 and 314 is around 40 $\mu$m. It can also be seen from these graphs that the electric field strength becomes the maximum in each vertex portions of the triangular shape of the ink guides 114 and 314 and are reduced within the ink guide grooves 126 and 326 and outside of the vertex portions in accordance with an increase in the distance from the vertex portions.

In addition, it was found that the ink jet head 146 according to the present invention has approximately the same characteristics as a conventional ink jet head 148 with regard to the electric field strength in the tip portions of the ink guides 114 and 314. That is, it was found that clearly different two states of the electric field strength were obtained at the time of ink ejection and ink non-ejection. Also from this fact, it can be said that it is possible to control the ink ejection/non-ejection in the ink jet head 146 according to the present invention in the same manner as in the case of the conventional ink jet head 148.

In other words, the most important point of the ink jet head 146 according to the present invention is that clearly different two states of the electric field strength are obtained at the time of ink ejection and ink non-ejection, as described above. Accordingly, it is sufficient that related parameters, such as the arrangement (positional relationship) of the first drive electrode 118 and the second drive electrode 120, the bias voltage of the second drive electrode 120, the bias voltage of the counter electrode 122, the thickness of the insulating substrate 116, the shape of the ink guide 114, and the area of the ink guide groove 126, are determined as appropriate.

Next, the present invention will be described based on another embodiment of the present invention.

Figure 10A:
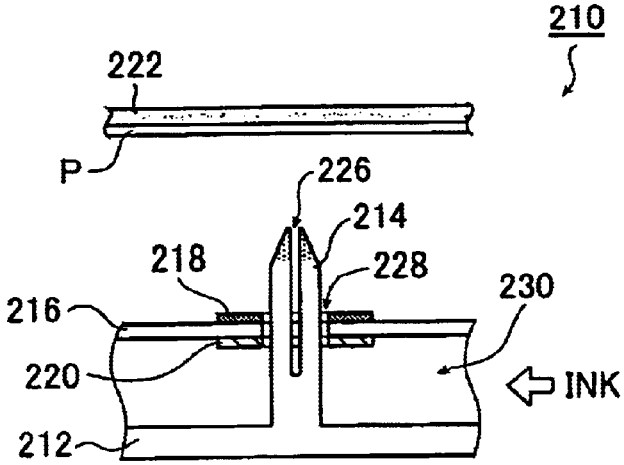
FIGS. 10A and 10B are respectively a conceptual construction diagram and a schematic perspective view of the electrostatic ejection type ink jet head according to further another embodiment of the present invention.
Figure 10B:
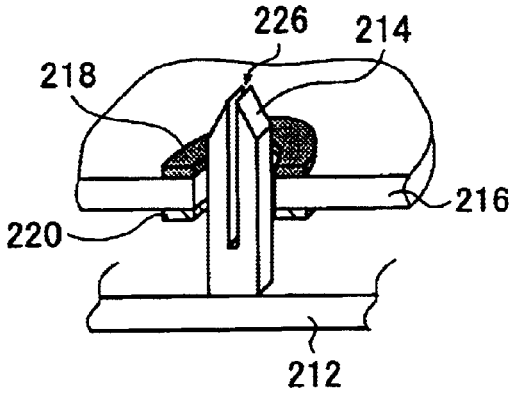

FIGS. 10A and 10B are respectively a conceptual construction diagram and a schematic perspective view of an electrostatic ejection type ink jet head according to the embodiment of the present invention. The electrostatic ejection type ink jet head 210 shown in these drawings also records an image corresponding to image data on a recording medium P by ejecting ink containing a charged fine particle component, such as pigment, by means of an electrostatic force. The ink jet head 210 includes a head substrate 212, an ink guide 214, an insulating substrate 216, a first drive electrode 218, a second drive electrode 220, and a counter electrode 222.

It should be noted here that also in FIGS. 10A and 10B, only one of individual electrodes constituting the ink jet head 210 is illustrated. Although details are to be described later, the ink jet head of this embodiment includes multiple individual electrodes arranged in a two-dimensional manner. It is possible to construct an ink jet head including a line head or at least a part of a line head through the application of the present invention. Also, the ink jet head of this embodiment is also ready for both of monochrome recording and color recording.

In the ink jet head 210 of this embodiment, the ink guide 214 is arranged on the head substrate 212 for each individual electrode, and a slit serving as an ink guide groove 226 is formed in the center portion of the ink guide 214 in a top-bottom direction in the drawings. Also, in the insulating substrate 216, a through hole 228 is established at a position corresponding to an arrangement of the ink guide 214. The ink guide 214 passes through the through hole 228 established in the insulating substrate 216 so that the tip portion thereof protrudes above the upper surface of the insulating substrate 216 in the drawing.

The tip portion of the ink guide 214 is also formed to an approximately triangular shape (or a trapezoidal shape) that is gradually narrowed toward the counter electrode 222 side, and a metal is evaporated onto the extreme tip portion thereof from which the ink is to be ejected. Although this metal evaporation is not indispensable but preferable because the dielectric constant in the extreme tip portion of the ink guide 214 becomes substantially infinite, and an effect, which is easy to cause a strong electric field, is produced. Note that the shape of the ink guide 214 may be changed as appropriate.

The head substrate 212 and the insulating substrate 216 are arranged with a predetermined space therebetween, and an ink flow path 230 is formed between the substrates 212 and 216. Also, the counter electrode 222 is arranged at a position opposing the tip portion of the ink guide 214, and a recording medium P is placed on the lower surface of the counter electrode 222 in the drawing. At the time of recording, the counter electrode 222 is constantly biased to a negative voltage level having an opposite polarity of the high voltage applied to the second drive electrode 220.

Also, the first drive electrode 218 has a ring shape and is provided for each individual electrode on the upper surface of the insulating substrate 216 in the drawing so as to surround the periphery of the through hole 228 established in the insulating substrate 216, with multiple first drive electrodes 218 arranged on the same row in a row direction (main scanning direction) being connected to each other. On the other hand, the second drive electrode 220 has a ring shape and is provided for each individual electrode on the lower surface of the insulating substrate 216 in the drawing so as to surround the periphery of the through hole 228 established in the insulating substrate 216, with multiple second drive electrodes 220 arranged on the same column in a column direction (auxiliary scanning direction) being connected to each other.

In this embodiment, at the time of recording, only the first drive electrodes 218 on a specific row are set to the high-voltage level or under a high-impedance state (ON state), and the first drive electrodes 218 on each remaining row are driven to a ground level (OFF state). Also, the second drive electrodes 220 of all columns are driven to the high-voltage level or the ground level in accordance with the image data. Note that as another embodiment, the first drive electrodes 218 and the second drive electrodes 220 may be driven in an opposite manner.

As described above, the first drive electrodes 218 and the second drive electrodes 220 are arranged to form a matrix having a two-layered electrode structure. By the first drive electrodes 218 and the second drive electrodes 220, ink ejection/non-ejection at respective individual electrodes is controlled. That is, when the first drive electrodes 218 are set to the high-voltage level or under the floating state and the second drive electrodes 220 are set to the high-voltage level, the ink will be ejected, and when either the first drive electrodes 218 or the second drive electrodes 220 are set to the ground level, the ink will not be ejected.

Figure 11:
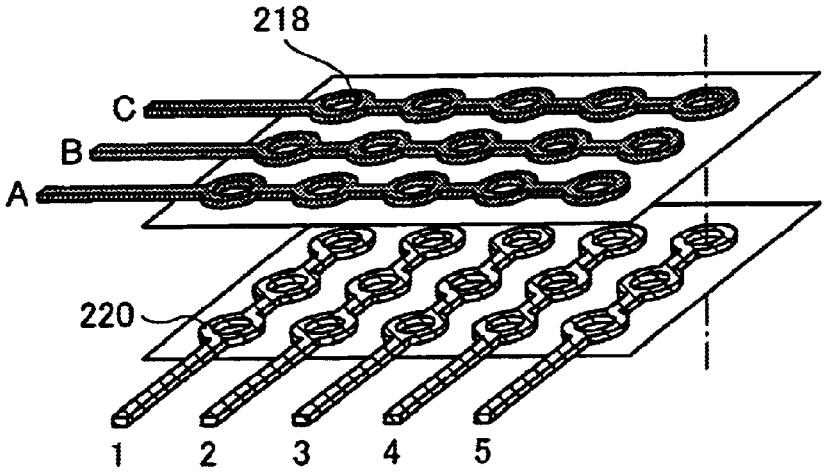
FIG. 11 is a conceptual diagram showing an arrangement of first drive electrodes and second drive electrodes used in the embodiment of the present invention.

FIG. 11 is an embodiment of a conceptual diagram showing an arrangement of the first drive electrodes and the second drive electrodes. As shown in this drawing, when the ink jet head 210 includes 15 individual electrodes, for instance, five out of fifteen individual electrodes (1, 2, 3, 4, and 5) are arranged on each row in a main scanning direction and three individual electrodes (A, B, and C) are arranged on each column in an auxiliary scanning direction. At the time of recording, the five first drive electrodes 218 arranged on the same row are simultaneously driven to the same voltage level. In the same manner, the three second drive electrodes 220 arranged on the same column are simultaneously driven to the same voltage level.

In the ink jet head 210 of this embodiment, the multiple individual electrodes are arranged in a two-dimensional manner with reference to a row direction and a column direction.

Figure 12:
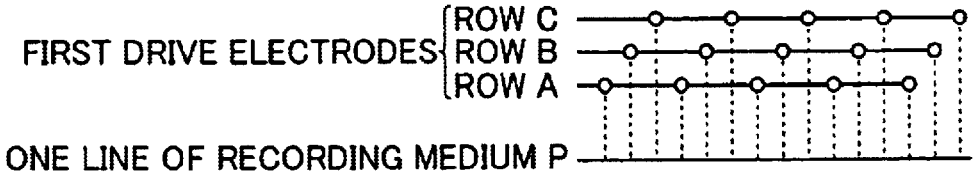
FIG. 12 is a conceptual diagram showing an arrangement of individual electrodes used in the embodiment of the present invention.

In the case of the ink jet head shown in FIG. 11, the five individual electrodes on the row A of the first drive electrodes 218 are arranged at predetermined intervals with reference to the row direction, as shown an example in FIG. 12. The same applies to the row B and the row C. Also, the five individual electrodes on the row B are spaced from the row A by a predetermined distance in the column direction and are respectively arranged between the five individual electrodes on the row A and the five individual electrodes on the row C with reference to the row direction. In the same manner, the five individual electrodes on the row C are spaced from the row B by a predetermined distance in the column direction and are respectively arranged between the five drive electrodes on the row B and the five drive electrodes on the row A with reference to the row direction.

The individual electrodes on each row of the first drive electrodes 218 are arranged so as to be displaced from the individual electrodes on other rows in the row direction, as described above. With this arrangement, one line to be recorded on the recording medium P is divided into three groups in the row direction.

That is, one line to be recorded on the recording medium P is divided into multiple groups, whose number is equal to the number of rows of the first drive electrodes 218, with reference to the row direction, and sequential recording is performed in a time-division manner. In the case of the arrangement shown in FIGS. 11 and 12, for instance, sequential recording is performed for the rows A, B, and C of the first drive electrodes 218, thereby recording one line of an image on the recording medium P. In this case, as described above, the one line to be recorded on the recording medium P is divided into three groups in the row direction and sequential recording is performed through time division.

Accordingly, in the matrix drive system adopted in the present invention, division recording is performed with reference to the row direction, so that the recording speed is lowered in accordance with an increase in the number of rows of the first drive electrodes 218. However, it becomes possible to reduce the number of drivers of the drive circuits, which provides an advantage that the implementation area is reduced. Also, although details are described later, with the present invention, it is also possible to appropriately determine the recording speed and the number of drivers as necessary, so that an advantage, which is possible to obtain the recording speed and implementation area of the drive circuit that are optimum for the system, is provided.

It should be noted here that in the ink jet head 210 of this embodiment, there is used a two-layered electrode structure formed by the first drive electrodes 218 and the second drive electrodes 220. However, the present invention is not limited to this, and there may be used any other electrode structures so long as at least two layers are formed by the drive electrodes.

The arrangement of the first drive electrodes 218 and the second drive electrodes 220 is the same as the arrangement of the first drive electrodes 118 and the second drive electrode 120 in the ink jet head 110 shown in FIGS. 1A and 1B.

That is, the first drive electrodes 218 is required to be arranged closer to the insulating substrate 216 side than the ink flow path 230. Also, the second drive electrodes 220 is required to be arranged closer to the head substrate 212 than the first drive electrodes 218. Note that in this embodiment, there may be appropriately determined whether (i) the first drive electrodes 218 perform driving in the row direction and the second drive electrodes 220 perform driving in the column direction or (ii) the first drive electrodes 218 perform the driving in the column direction and the second drive electrodes 220 perform the driving in the row direction.

Also, an electrophoretic electrode, which is biased to a voltage level having the same polarity as the fine particle component contained in the ink and energizes the fine particle component toward the insulating substrate 216 side at the time of image recording, may be provided. This electrophoretic electrode needs to be arranged closer to the head substrate 212 side than the ink flow path 230. Also, it is preferable that the electrophoretic electrode is arranged on the upstream side of the ink flow path 230 with reference to the position of the individual electrode. With this electrophoretic electrode, it becomes possible to maintain the fine particle component contained in ejected ink at a predetermined concentration.

It should be noted here that the arrangements of the first drive electrodes 218, the second drive electrodes 220, and the electrophoretic electrode are not specifically limited so long as the mutual positional relationships described above are satisfied. For instance, the first drive electrodes 218 and the second drive electrodes 220 may be arranged on the upper surface and the lower surface of the insulating substrate 216 in the drawing, or both or either of the electrodes 218 and 220 may be arranged inside of the insulating substrate 216. Also, the second drive electrodes 220 and the electrophoretic electrode may be arranged on the upper surface or the lower surface of the head substrate 212 in the drawing or be arranged inside thereof.

Next, there will be described a drive circuit for the first drive electrodes 218 and the second drive electrodes 220.

Figure 13:
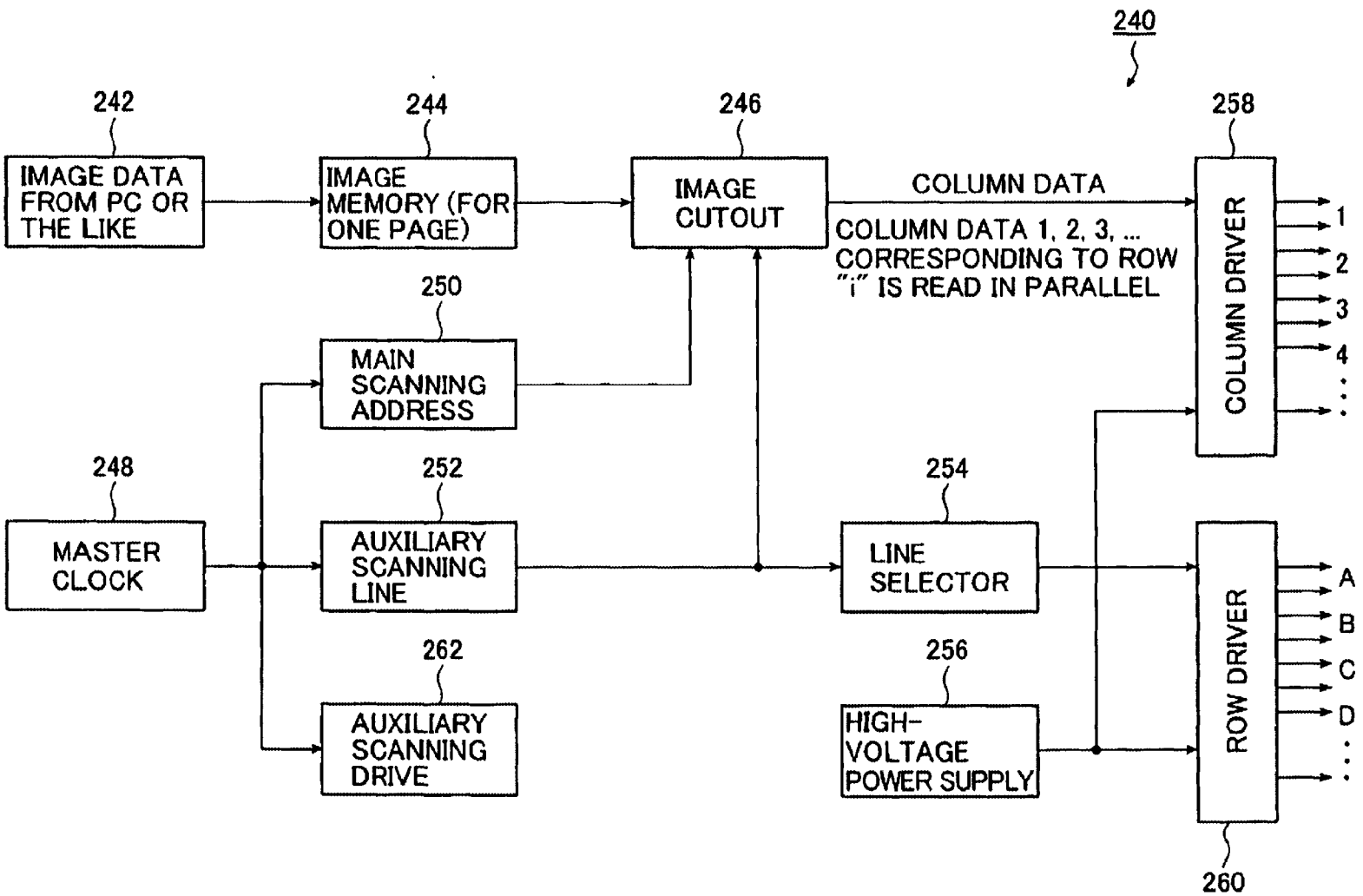
FIG. 13 is a conceptual block diagram showing a construction of a drive circuit for the drive electrodes used in the embodiment of the present invention.

FIG. 13 is an embodiment of a conceptual block diagram showing a construction of the drive circuit for the drive electrodes. The drive circuit 240 shown in the drawing controls the driving of the first drive electrodes 218 and the second drive electrodes 220, and includes an image memory 244, an image cutout unit 246, a master clock generating unit 248, a main scanning address control unit 250, an auxiliary scanning line control unit 252, a line selector 254, a high-voltage power supply 256, a column driver 258, and a row driver 260.

In the drive circuit 240 of the illustrated example, the image memory 244 holds one page of image data supplied from an apparatus such as a personal computer (PC) 242. The image data outputted from the image memory 244 is supplied to the image cutout unit 246.

The master clock generating unit 248 generates a master clock signal for controlling operation timings in the drive circuit 240. The generated master clock signal is supplied to the main scanning address control unit 250, the auxiliary scanning line control unit 252, and an auxiliary scanning drive unit 262, and these construction elements operate in synchronization with the supplied master clock signal.

The main scanning address control unit 250 controls which column of the second drive electrodes 220 in the main scanning direction is turned on (that is, to be set to the high-voltage level) and which column of the second drive electrodes 220 in the main scanning direction is turned off (that is, to be set to the ground level). Also, the auxiliary scanning line control unit 252 controls which row of the first drive electrodes 218 in the auxiliary scanning direction is turned on (that is, to be set under the high-impedance state or at the high-voltage level) and which row of the first drive electrodes 218 in the auxiliary scanning direction is turned off (that is, to be set to the ground level).

The above-mentioned main scanning address control unit 250 and the auxiliary scanning line control unit 252 perform computation based on the arrangement state of each individual electrode, the relative moving speed between the ink jet head 210 and the recording medium P, and the like.

The image cutout unit 246 reads, from the image memory 244, multiple pieces of image data corresponding to a row "i" to be turned on (that is, to be set to the high-voltage level or under the high-impedance state) by the row driver 260, based on results of the computation by the main scanning address control unit 250 and the auxiliary scanning line control unit 252. The read multiple pieces of image data are supplied in parallel to the column driver 258 as column data. Due to this image data, the driving of the column of the second drive electrodes 220 corresponding to the row "i" is controlled.

The auxiliary scanning line control unit 252 performs control so that only one row is turned on at a time and all rows are turned on sequentially. Based on the result of the computation by the auxiliary scanning line control unit 252, a line selector 254 outputs multiple control signals for setting one row to be turned on at the high-voltage level or under the high-impedance state and setting all remaining rows to be turned off at the ground level. The multiple control signals are supplied to the row driver 260, and the driving of all rows of the first drive electrodes 218 are controlled by the supplied control signals.

The high-voltage power supply 256 supplies the high-voltage level to the row driver 258 and the column driver 260. Based on the image data supplied from the image cutout unit 246, the column driver 258 drives each corresponding second drive electrode 220 to either of the high-voltage level and the ground level. Also, based on the control signals supplied from the line selector 254, the row driver 260 sets one row to be turned on at the high-voltage level or under the high-impedance state and drives all remaining rows to the ground level.

Here, the auxiliary scanning drive unit 262 is also illustrated in FIG. 13. The ink jet head 210 of this embodiment is a line head, and the auxiliary scanning drive unit 262 relatively moves the ink jet head 210 and the recording medium P in the column direction.

It should be noted here that the circuit construction of the drive circuit 240 is not specifically limited, and any circuit construction having the same function may be used. Also, the concrete circuit construction of each construction element of the drive circuit 240 shown in FIG. 13 is not specifically limited, and any circuit construction having the same function may be used.

Next, there will be described the row driver 260 showing an example.

Figure 14:
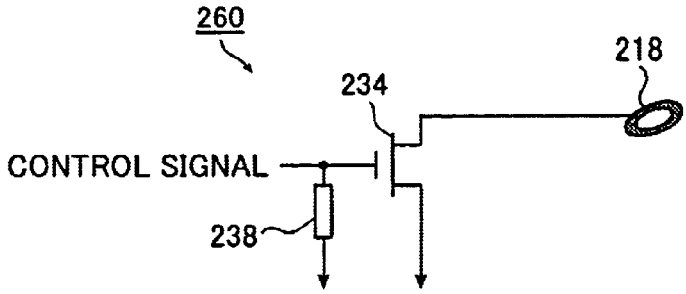
FIG. 14 is a conceptual construction diagram of a row driver used in the embodiment of the present invention.

FIG. 14 is an embodiment of a conceptual construction diagram of the row driver. The row driver 260 shown in this drawing has the same construction as the drive circuit 32 shown in FIG. 4 and includes an open-drain type FET (field-effect transistor) 234 and a resistive element 238. The drain of the FET 234 is connected to the first drive electrode 218, the source of it is connected to the ground, and the gate of it receives input of a control signal. Also, the resistive element 238 is connected between the control signal and the ground.

In the row driver 260, the control signal is changed into the high level or the low level in accordance with the image data. When the control signal is set to the high level, the FET 234 is turned on, and the first drive electrode 218 becomes the ground level. On the other hand, when the control signal is set to the low level, the FET 234 is turned off, and the first drive electrode 218 is placed under a high-impedance (floating) state. That is, the first drive electrode 218 is switched between the ground level and the high-impedance state in accordance with the control signal supplied from the above mentioned line selector 254.

It should be noted here that the row driver 260 is not limited to the construction of the illustrated example, and any circuit construction may be used so long as it is possible to switch the potential of the first drive electrode 218 between the ground level and the high-impedance state. Further, the FET 234 is used as a switching element in this embodiment, but the present invention is not limited to this, and it is possible to use any conventionally known switching element such as a bipolar transistor.

Figure 19:
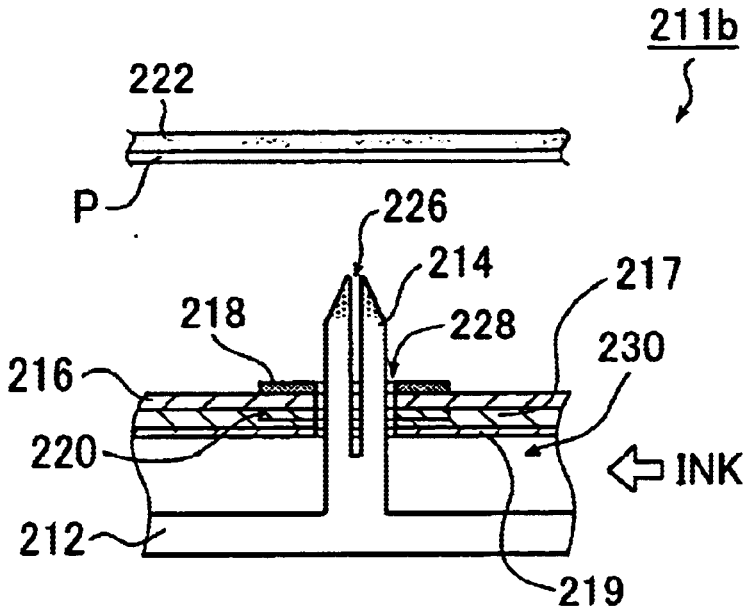
FIG. 19 is a conceptual construction diagram of an electrostatic ejection type ink jet head according to a modification of the embodiment of the present invention.

When the first drive electrodes 218 are switched between the high-voltage level and the ground level by the row driver 260, it is possible for the column driver 258 to use a circuit having the construction shown in FIG. 19, for instance. Also in this case, the driver is not limited to the driver of the illustrated example, and it is possible to use any circuit construction so long as it is possible to switch the first drive electrodes 218 and the second drive electrodes 220 between the ground level and the high-voltage level.

Next, an operation of the ink jet head 210 of this embodiment will be described. Note that in the following description, a case where the first drive electrodes 218 are switched between the ground level and the high-impedance state will be explained as an example.

In the ink jet head 210 of this embodiment, at the time of recording, ink containing a fine particle component, such as a pigment, and charged to the same polarity as the high-voltage level applied to the second drive electrode 220 is circulated by a not-shown pump or the like in a direction from the right to the left inside of the ink flow path 230 in FIGS. 10A and 10B.

Figure 15A:
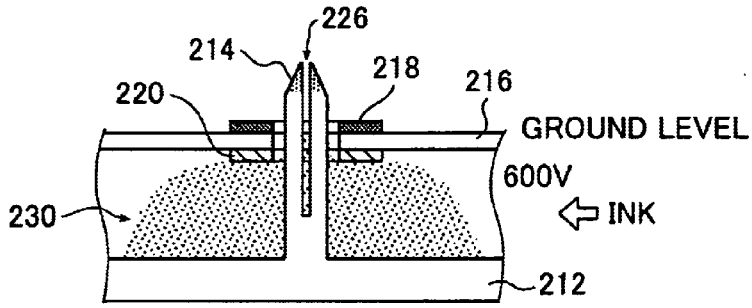
FIG. 15A is a conceptual diagram showing a state at the time of ink non-ejection of the electrostatic ejection type ink jet head according to the embodiment of the present invention.

As shown in FIG. 15A, even when the second drive electrodes 220 are set to a high-voltage level of 600 V, for instance, the electric field strength in proximity to the tip portion of the ink guide 214 is low when the first drive electrode 218 is set to the ground level, so that the ink will not fly out from the tip portion of the ink guide 214. In this case, a part of the ink moves upward along the ink guide groove 226 formed in the ink guide 214 due to capillary action until above the lower surface of the insulating substrate 216 in the drawing.

Figure 15B:
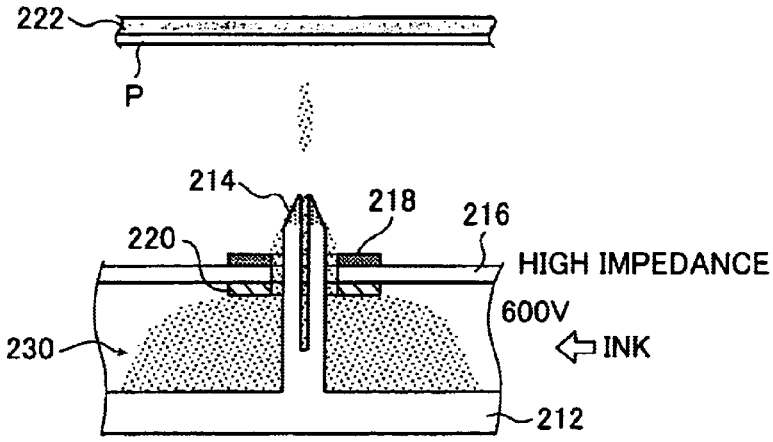
FIG. 15B is a conceptual diagram showing a state at the time of ink ejection of the electrostatic ejection type ink jet head according to the embodiment of the present invention.

On the other hand, when the first drive electrode 218 is placed under the high-impedance state as shown in FIG. 15B, the electric field strength in proximity to the tip portion of the ink guide 214 is increased. At that time, the ink, which moved upward along the ink guide groove 226 of the ink guide 214 until above the lower surface of the insulating substrate 216 in FIGS. 10A and 10B, flies out from the tip portion of the ink guide 214 due to a repulsion force. The ink is then attracted to the counter electrode 222 biased to −1.5 kV, for example, and adheres onto the recording medium P.

As mentioned above, the ink jet head 210 and the recording medium P placed on the counter electrode 222 are relatively moved, thereby recording an image corresponding to image data on the recording medium P.

It should be noted here that almost the same operation is performed when the first drive electrodes 218 are switched between the ground level and the high-voltage level. As described above, in the ink jet head 210 of this embodiment, the ink is not ejected when either the first drive electrodes 218 or the second drive electrodes 220 are set to the ground level, and the ink is ejected only when the first drive electrodes 218 are set under the high-impedance state or at the high-voltage level and the second drive electrodes 220 are set to the high-voltage level.

That is, in the ink jet head 210 of this embodiment, it is important that clearly different two states of the electric field strength are obtained at the time of ink ejection and ink non-ejection. Accordingly, it is sufficient that related parameters, such as the arrangement (positional relationship) of the first drive electrodes 218 and the second drive electrodes 220, the high voltage level applied to the first drive electrodes 218 and the second drive electrodes 220, the bias voltage of the counter electrode 222, the thickness of the insulating substrate 216, the shape of the ink guide 214, and the area of the ink guide groove 226, are determined as appropriate.

In the ink jet head 210 of this embodiment, when the first drive electrodes 218 are switched between the high-impedance state and the ground level, the switching of the high voltage is not performed by the FET 234 at the time of recording, so that an advantage, which is not consumed a large electric power by the switching of the FET 234, is produced. Accordingly, when an ink jet head is required to perform high-definition recording at high speed, it becomes possible to significantly reduce power consumption.

Also, in the ink jet head 210 of this embodiment, the individual electrodes are arranged in a two-dimensional manner and matrix driving is performed, so that it becomes possible to significantly reduce the number of row drivers 260 and the number of column drivers 258. Further, it becomes possible to significantly reduce the implementation area and power consumption of the drive circuit 240. Also, it becomes possible to arrange the individual electrodes while maintaining relative margins therebetween, so that it becomes possible to extremely reduce a danger that discharge may occur between the electrodes. As a result, it becomes possible to cope with both high-density implementation and high-voltage operation with safety.

By the way, the recording speed and the number of drivers (implementation area) are generally in a mutually contradictory relationship. Accordingly, in the ink jet head 210 of this embodiment, although the reduction in the number of drivers contributes to the reduction in the implementation area and power consumption, the recording speed is lowered in accordance with an increase in the number of rows of the first drive electrodes 218. In the above embodiment, in order to further increase the recording speed, it is required to increase the number of drivers. In this case, however, the implementation area and power consumption are increased, as described above.

When the individual electrodes are arranged in a two-dimensional manner and matrix driving is performed through the application of the present invention, if the row/column ratio in the arrangement of the individual electrodes stands at "1 to 1" as in the case of the above embodiment, it becomes possible to minimize the number of drivers. In the case of the line head described in the "Description of the prior art" section that includes 12000 individual electrodes, for instance, the row/column ratio in the arrangement of the electrodes stands at "1 to 1" and the individual electrodes are arranged in a matrix shape with 110 rows and 110 columns, thereby minimizing the number of required drivers to 220.

In contrast to this, by providing one driver for each drive electrode as in the conventional case, it becomes possible to maximize the recording speed, although the line head including the 12000 individual electrodes needs to use 12000 drivers and the implementation area and power consumption of the drive circuit are increased. As a result, there is not obtained a realistic system, as described above. Accordingly, it is preferable that the number of drivers is appropriately adjusted as necessary, and the recording speed and the implementation area are optimized in accordance with the system.

When the individual electrodes are arranged in a two-dimensional manner and matrix driving is performed through the application of the present invention, in order to obtain recording speed which is faster than that in the case where the row/column ratio in the arrangement of the individual electrodes stands at "1 to 1", it is preferable that the above embodiment is modified so that the number of the individual electrodes arranged on each row in the row direction is increased and the number of the individual electrodes arranged in the column direction is inversely decreased. It is also preferable that the rows of the first drive electrodes 218 are divided into multiple groups, each of which include one or multiple rows, thereby making it possible to perform simultaneous recording for these multiple groups.

The above arrangement with 110 rows and 110 columns is changed to an arrangement with (110/4=around 28) rows and (110×4=440) columns, for instance. In that case, the number of individual electrodes on each row becomes "440". When the ink jet head 210 of this embodiment is a line head that is capable of recording an image on a recording medium P that is 10 inch in width, the pitch between the individual electrodes becomes around 500 $\mu$m that is ¼ of around 2.3 mm, but the number of rows is reduced to around ¼, so that the recording speed is increased around four-fold.

In the case of a simple drive system such as the conventional ink jet head in which each individual electrode is provided with one driver for driving the electrode, it is required to route lines connecting respective individual electrodes to their corresponding drivers through spaces between the individual electrodes. Accordingly, in the case of high-density implementation, there is a large danger that causes discharge between the individual electrodes. In contrast to this, in the case of the matrix drive system adopted in the present invention, it is not required to route the lines through spaces between the individual electrodes, which provides an advantage in that any danger of discharge hardly causes.

It should be noted here that in the above embodiment, the number of rows is reduced to ¼ and the number of columns is increased four-fold, but the present invention is not limited to this, and it is preferable that the number of rows and the number of columns are appropriately changed as necessary. When the individual electrodes in the column direction are sequentially driven by the second drive electrodes 220 and the individual electrodes in the row direction are driven by the first drive electrodes 218 in accordance with image data in contrast to the aforementioned case, for instance, it is preferable that the number of rows of the individual electrodes is set more than the number of columns thereof.

Figure 16A:
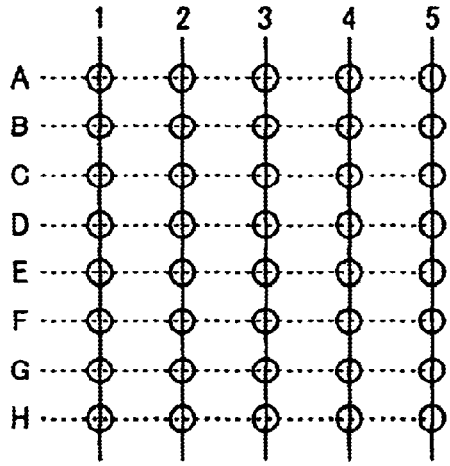
FIG. 16A is an embodiment of a conceptual diagram showing a state where rows of the first drive electrodes are not divided into groups.

Next, a case where the rows of the first drive electrodes 218 are divided into multiple groups will be described. When all the rows of the first drive electrodes 218 are not divided and are dealt with as a single group, for instance, recording is possible only for one row of the first drive electrodes 218 at a time. When an ink jet head includes eight rows A to H, and these eight rows A to H are dealt with as one group as shown in FIG. 16A, for instance, recording in units of rows is performed in order from the row A to the row H.

Figure 16B:
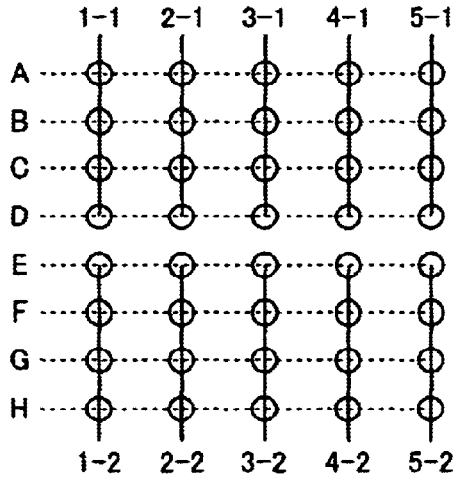
FIG. 16B is an embodiment of a conceptual diagram showing a state where the rows of the first drive electrodes are divided into two groups.

In contrast to this, when the rows are divided into two groups, it becomes possible to perform recording on two rows of the first drive electrodes 218 at a time. When four rows A to D are set as a first group and four rows E to H are set as a second group as shown in FIG. 16B, for instance, it becomes possible to perform recording on two rows A and E at the same time (a row "1-1 to 5-1" and a row "1-2 to 5-2" are driven at the same time). In the same manner, it is possible to perform recording on the rows B and F, the rows C and G, and the rows D and H at the same time.

In that case, the rows of the first drive electrodes 218 are divided into two groups, so that the number of the column drivers is doubled, that is, the implementation area and power consumption of the drive circuit are doubled, but the recording speed can also be doubled.

Figure 16C:
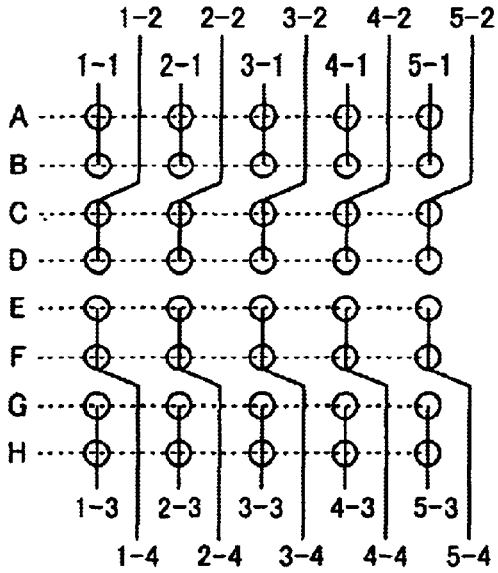
FIG. 16C is an embodiment of a conceptual diagram showing a state where the rows of the first drive electrodes are divided into four groups.

Also, when the rows of the first drive electrodes are divided into four groups, it becomes possible to perform recording on four rows at a time. When the rows A and B are set as a first group, the rows C and D are set as a second group, the rows E and F are set as a third group, and the rows G and H are set as a fourth group as shown in FIG. 16C, for instance, it becomes possible to perform recording on four rows A, C, E, G at the same time (a row "1-1 to 5-1", a row "1-2 to 5-2", a row "1-3 to 5-3", row "1-4 to 5-4" are driven at the same time). In the same manner, it is possible to perform recording on the rows B, D, F, and H at the same time.

In this case, the rows of the first drive electrodes 218 are divided into four groups, so that the number of column drivers is increased four-fold, but the recording speed is also increased four-fold.

By dividing the rows of the first drive electrodes 218 into multiple groups that each of the groups contain at least one row and performing simultaneous recording for the multiple groups in this manner, the recording speed is increased several-fold only by adding a small number of drivers. Note that the present invention is not limited to the above embodiments and the rows of the first drive electrodes 218 may be divided into any number of groups.

Also, when the individual electrodes are arranged at a high density, there happens a case where the electric field generated by each individual electrode is influenced by the state of its adjacent individual electrodes and the recording quality is adversely affected.

When the rows of the first drive electrodes 218 constituting the upper layer (on the counter electrode 222 side) are sequentially turned on and the second drive electrodes 220 constituting the lower layer (on the head substrate 212 side) are turned on/off in accordance with image data like in the above embodiment, for instance, the second drive electrodes 220 are driven in accordance with the image data, so that the individual electrodes on both sides of each individual electrode in the column direction frequently changes between the high-voltage level and the ground level.

In the row direction, however, the first drive electrodes 218 are driven in units of rows, and the first drive electrodes 218 of the individual electrodes on both sides of each individual electrode in the row direction is constantly set to the ground level. Therefore, the rows of the individual electrodes on both sides play a role as a guard electrode. By sequentially turning on each row of the first drive electrodes 218 of the upper layer and driving the second drive electrodes 220 of the lower layer in accordance with image data in this manner, it becomes possible to eliminate an influence of adjacent individual electrodes and to improve recording quality.

Figure 17:
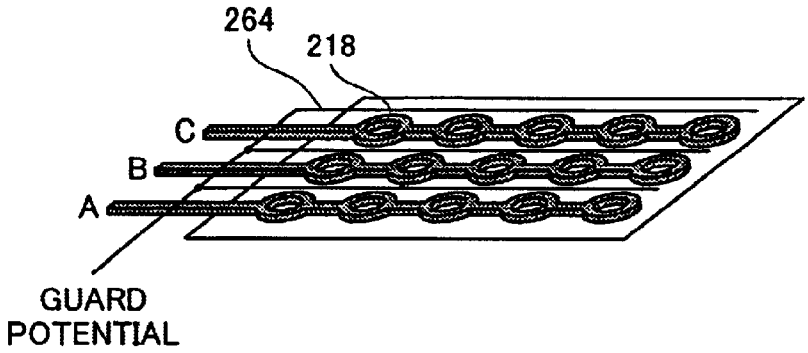
FIG. 17 is a conceptual construction diagram showing an arrangement of guard electrodes used in the embodiment of the present invention.

On the other hand, it is also possible to sequentially drive the second drive electrodes 220 of the lower layer in units of columns and to drive the first drive electrodes 218 of the upper layer in accordance with image data. That is, the arrangement of the rows and columns may be interchanged. In that case, it is preferable that a guard electrode 264 is provided in each space between the rows of the first drive electrodes 218, as shown in FIG. 17. With this construction, by biasing the guard electrode 264 to a predetermined guard potential (ground level, for instance) at the time of recording, it becomes possible to eliminate the influence of adjacent individual electrodes.

Next, the present invention will be described based on further another embodiment.

Figure 18A:
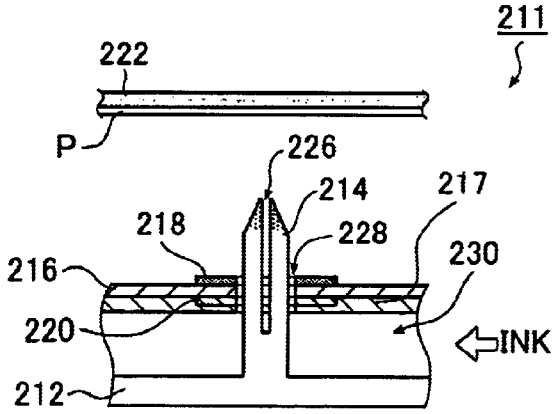
FIGS. 18A and 18B are respectively a conceptual construction diagram and a schematic perspective view of an electrostatic ejection type ink jet head according to the embodiment of the present invention.
Figure 18B:
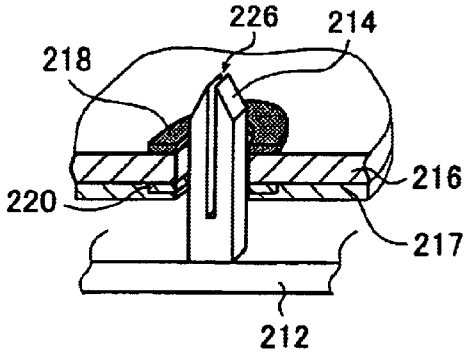

FIGS. 18A and 18B are respectively a conceptual construction diagram and a schematic perspective view of an electrostatic ejection type ink jet head according to the embodiment of the present invention. The electrostatic ejection type ink jet head 211 shown in these drawings has a construction where the ink jet head 210 shown in FIGS. 10A and 10B is further provided with a coating film 217 that coats the surfaces of the insulating substrate 216 and the second drive electrode 220. In the following description, the same construction elements as in the both embodiment are given the same reference numerals and the detailed description thereof will be omitted.

In the ink jet head 211, the through hole 228 is established at a position corresponding to an arrangement of the ink guide 214 so as to pass through the insulating substrate 216, the first drive electrode 218, the second drive electrode 220, and the coating film 217. The coating film 217 coats the second drive electrode 220 that forms a step portion having a height equal to the thickness thereof on the ink flow path 230 side of the insulating substrate 216, and forms an inner wall of the ink flow path 230 through which the ink flows.

The ink jet head 211 according to this embodiment performs fundamentally the same operation as the ink jet head 210 shown in FIGS. 10A and 10B. However, the inner wall of the ink flow path 230 formed in the manner described above has a surface smoothed by the coating film 217, so that ink turbulence, which is caused by the step portion formed by the second drive electrode 220, is prevented. As a result, it becomes possible to eject the ink from the ink guide 214 with stability and to prevent accumulation of the ink in the step portion.

That is, when the coating film 217 is not provided, a step portion is formed between the insulating substrate 216 and the second drive electrode 220, so that turbulence occurs in the ink flowing through the ink flow path 230 and the charged fine particles contained in the ink are not efficiently guided to the tip portion of the ink guide 214. In contrast to this, with the construction of this embodiment in which the coating film 217 is provided, a smooth surface of the inner wall is achieved by the coating film 217, so that it is possible to eliminate such a step portion that is a cause of the ink turbulence and becomes a location at which adhesion of the ink occurs. As a result, it becomes possible to eject the ink from the ink guide 214 with stability and to prevent the ink adhesion.

By the way, the ink guide groove 226 of the ink guide 214 has a minute width of dozens of $\mu$, so that adhesion of the fine particles of the ink easily occurs. Therefore, cleaning work is periodically conducted by pouring a cleaning agent called "ISOPER" into the ink flow path 230. The inner wall of the ink flow path 230 is smoothed by the coating film 217 as described above, so that also at the time of this cleaning work, it is possible to smoothly wash away an ink lump peeled off the inside wall of the ink flow path 230 by the cleaning agent.

It should be noted here that it is preferable that the coating film 217 is an $SiO_2$ film or a polyimide film. Also, the insulating substrate 216 may be a ceramic substrate made of alumina or zirconia. Further, it is preferable that the material of the coating film 217 and the material of the insulating substrate 216 are selected so that the specific inductive capacities thereof are identical to each other. Note that as to the identical degree, it is not required that these specific inductive capacities are completely identical to each other so long as no significant influence is exerted on ejection characteristics. This is because if the specific inductive capacities are close to each other, unnecessary electric field concentration is also reduced.

Further, it is preferable that the material of the coating film 217 and the material of the insulating substrate 216 are selected so that the linear expansion coefficients thereof are identical to each other. Note that as to the identical degree, it is not required that these linear expansion coefficients are completely identical to each other so long as a situation where the whole of the substrate is curved due to temperature fluctuations and the coating film 217 is not peeled off the insulating substrate 216. To prevent this peeling-off, it is preferable that a manufacture also considers a construction where a strongly adhesive layer is provided between the insulating substrate 216 and the coating film 217.

Also, the specific inductive capacities and the linear expansion coefficients may be changed so as to be identical to each other using a ceramic substrate produced by changing the composition, forming conditions, or sintering conditions of alumina or zirconia and using a coating film produced by mixing an impurity into the $SiO_2$ film or the polyimide film.

As the impurity mixed into alumina, it is possible to use "MgO" that is effective to change the linear expansion coefficient, for instance. Also, as the impurity mixed into zirconia, it is possible to use "C" that is effective to change the specific inductive capacity. Further, in order to change the linear expansion coefficient, it is effective to change the forming pressure and the sintering conditions (temperature and period of time).

Also, as the impurity mixed into $SiO_2$, it is possible to use "$TiO_2$, $AL_2O_3$" that are effective to change the specific inductive capacity and to use "Na, B" that are effective to change the linear expansion coefficient. As the impurity mixed into polyimide, it is possible to use fillers (glass fibers, barium titanate) having different dielectric constants to thereby change the specific inductive capacity. It is also preferable that an inorganic filler, such as glass, is mixed in order to change the linear expansion coefficient.

Also, with a ceramic substrate made of "SEICERAM RZ601" commercially available from Sumitomo Electric Industries, Ltd. and a coating film made of "Kapton™" (polyimide) commercially available from Du Pont Kabushiki Kaisha, it becomes possible to produce an electrostatic ejection type ink jet head having a preferable relationship between the specific inductive capacity and the linear expansion coefficient. Here, the "SEICERAM RZ601" is 30 in specific inductive capacity and is 9.5 [ppm per degree centigrade] in linear expansion coefficient, while the "Kapton™" is 3.5 in specific inductive capacity and is 20 [ppm per degree centigrade] in linear expansion coefficient.

Next, there will be described modifications of the ink jet head 211 of this embodiment.

FIG. 19 is a modification of a conceptual construction diagram of an electrostatic ejection type ink jet head 211 according to the present invention. The same construction elements as in the above embodiment are given the same reference numerals. Also, a description other than characteristics of this modification is the same as those described above, so that the description thereof will be omitted.

The electrostatic ejection type ink jet head 211*b* of this modification further includes a fluorine film 219 laminated on the coating film 217 coating the insulating substrate 216 and the second drive electrode 220. This fluorine film 219 is made of fluorine having ink repellency and coats the inner wall of the ink flow path 230, so that it becomes possible to prevent sticking of the ink to the inner wall surface. Also, this fluorine film 219 is laminated on a smooth surface obtained by coating the second drive electrode 220 with the coating film 217, so that the smooth inner wall surface of the ink flow path 230 is further given ink repellency.

Figure 20:
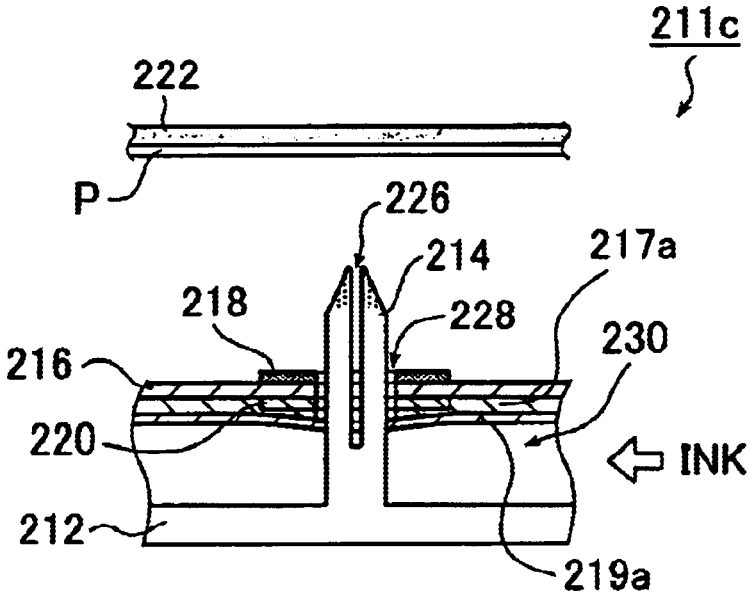
FIG. 20 is a conceptual construction diagram of an electrostatic ejection type ink jet head according to another modification of the embodiment of the present invention.

FIG. 20 is another modification of a conceptual construction diagram of an electrostatic ejection type ink jet head according to the present invention. The same construction elements as in the above modification are given the same reference numerals. Also, a description other than characteristics of this modification is the same as those described above, so that the description thereof will be omitted.

In the electrostatic ejection type ink jet head 211*c* shown in FIG. 20, a coating film 217*a* that coats the insulating substrate 216 and the second drive electrode 220 and is provided in place of the aforementioned coating film 217, and a fluorine film 219*a* laminated on the coating film 217*a* and is provided in place of the aforementioned fluorine film 219. That is, in the above embodiment, the inner wall of the ink flow path 230 has a smooth surface. In this modification, however, the step portion formed by the second drive electrode 220 is coated with a streamlined surface, thereby preventing the ink turbulence and the ink sticking.

The electrostatic ejection type ink jet head according to the present invention is fundamentally constructed and operated in the manner described above.

The electrostatic ejection type ink jet head according to the present invention has been described in detail above, but the present invention is not limited to the above embodiments, and as a matter of course, various improvements and modifications are possible without departing from the scope of the present invention.

As described in detail above, according to the present invention, switching to a high voltage is not performed at the time of image recording, so that no large electric power is consumed by switching. As a result, it becomes possible to significantly reduce power consumption even in an ink jet head that is required to perform high-definition recording at high peed. Also, according to the present invention, even when individual electrodes and drive circuits are implemented at a physically extremely high density, the advantage, which hardly causes any danger of discharge and is possible to cope with both high-density implementation and high-voltage operation with safety, is provided. Further, according to the present invention, individual electrodes are arranged in a two-dimensional manner and matrix driving is performed, so that it become possible to significantly reduce the number of drivers and to significantly reduce the implementation area and power consumption of the drive circuit.

Also, according to the present invention, by appropriately adjusting the numbers of rows and columns of the matrix of the individual electrodes or by dividing the individual electrodes in the row direction into multiple groups, it becomes possible to obtain an optimum recording speed and implementation area. Also, according to the present invention, by providing a guard electrode, it becomes possible to eliminate the influence of adjacent individual electrodes.

Also, according to the present invention, a coating film, which coats a drive electrode provided on the ink flow path side of an insulating substrate in proximity to an ink guide, is provided, so that it becomes possible to coat a step portion formed by the drive electrode with the coating film and to realize a smooth inner wall surface of the ink flow path. That is, the step portion is eliminated from the ink flow path. Therefore, ink turbulence due to the step portion is suppressed and adhesion of ink to the step portion is prevented. As a result, smooth flowing and smooth circulation of the ink through the ink flow path in proximity to the ink guide are realized, which makes it possible to perform recording on a recording medium with stability.

What is claimed is:

1. An electrostatic ejection type ink jet head that uses ink containing a charged fine particle component, controls ejection/non-ejection of the ink by means of an electrostatic force by applying a predetermined voltage to individual electrodes in accordance with image data, and records an image corresponding to the image data on a recording medium, the electrostatic ejection type ink jet head comprising:

a head substrate;

first drive electrodes provided for each of the individual electrodes;

a second drive electrode provided commonly among all of the individual electrodes;

ink guides arranged on the head substrate for each of the individual electrodes; and an insulating substrate in which through holes are established for each of the individual electrodes at a position corresponding to an arrangement of the ink guides, wherein the head substrate and the insulating substrate are arranged with a predetermined space therebetween, a flow path of the ink is formed between the head substrate and the insulating substrate, the ink guides are passed through the through holes established in the insulating substrate, tip portion of the ink guides are protruded above a surface of the insulating substrate on a recording medium side, the first drive electrodes are arranged closer to the insulating substrate side than the flow path of the ink, and the second drive electrode is arranged closer to the head substrate side than the first drive electrodes, and at the time of recording of the image, ejection/non-ejection of the ink is controlled by biasing the second drive electrode to a predetermined voltage level having the same polarity as the fine particle component contained in the ink and switching the first drive electrodes between a high-impedance state and a ground level in accordance with the image data.

2. The electrostatic ejection type ink jet head according to claim 1, further comprising an electrophoretic electrode provided commonly among all of the individual electrodes and arranged closer to the head substrate side than the ink flow path, wherein the time of recording of the image, the electrophoretic electrode is biased to a predetermined voltage level having the same polarity as the fine particle component contained in the ink.

3. The electrostatic ejection type ink jet head according to claim 1, further comprising a third drive electrode provided commonly among all of the individual electrodes and arranged closer to the recording medium side than the first drive electrode, wherein at the time of recording of the image, the third drive electrode is biased to a predetermined voltage level having reversed polarity as the fine particle component contained in the ink.

4. An electrostatic ejection type ink jet head that uses ink containing a charged fine particle component, controls ejection/non-ejection of the ink by means of an electrostatic force by applying a predetermined voltage to a plurality of individual electrodes arranged in a two-dimensional manner with reference to a first direction and a second direction in accordance with image data, and records an image corresponding to the image data on a recording medium, the electrostatic ejection type ink jet head comprising:

a head substrate;

first drive electrodes and second drive electrodes provided for each of the individual electrodes to form a two-layered electrode structure;

ink guides arranged on the head substrate for each of the individual electrodes; and an insulating substrate in which through holes are established for each of the individual electrodes at a position corresponding to an arrangement of the ink guide, wherein the head substrate and the insulating substrate are arranged with a predetermined space therebetween, a flow path of the ink is formed between the head substrate and the insulating substrate, the ink guides are passed through the through holes established in the insulating substrate, tip portion of the ink guides are protruded above a surface of the insulating substrate on a recording medium side, the first drive electrodes are arranged closer to the insulating substrate side than the flow path of the ink, the second drive electrodes are arranged closer to the head substrate than the first drive electrodes, the first drive electrodes on each line of the plurality of individual electrodes arranged in the first direction are connected mutually, and the second drive electrodes on each line of the plurality of individual electrodes arranged in the second direction are connected mutually, and wherein the ejection/non-ejection of the ink at the time of recording of the image is controlled by sequentially repeating one of an operation (i) in which the second drive electrodes on all lines of the individual electrodes in the second direction are set to a high voltage level or a ground level in accordance with the image data under a state where the first drive electrodes on one line of the individual electrodes in the first direction are set under a high-impedance state and the first drive electrodes on all remaining lines of the individual electrodes in the first direction are set to a ground level while sequentially changing the first drive electrodes on the line of the individual electrodes in the first direction that are set under the high-impedance state, and an operation (ii) in which the first drive electrodes on all lines of the individual electrodes in the first direction are set to a high-voltage level or the ground level in accordance with the image data under a state where the second drive electrodes on one line of the individual electrodes in the second direction are set under the high-impedance state and the second drive electrodes on all remaining lines of the individual electrodes in the second direction are set to the ground level while sequentially changing the second drive electrodes on the line of the individual electrodes in the second direction that are set under the high-impedance state.

5. The electrostatic ejection type ink jet head according to claim 4, further comprising:

guard electrodes that are provided between the lines of the first drive electrodes in the first direction and is biased to a predetermined certain voltage level at the time of recording of the image, wherein the ejection/non-ejection of the ink at the time of recording of the image is controlled by sequentially repeating one of an operation (i) in which the first drive electrodes on all lines of the individual electrodes in the first direction are set to a high voltage level or a ground level in accordance with the image data under a state where the second drive electrodes on one line of the individual electrodes in the second direction are set under a high-impedance state and the second drive electrodes on all remaining lines of the individual electrodes in the second direction are at a ground level while sequentially changing the second drive electrodes on the line of the individual electrodes in the second direction that are set under the high-impedance state, and an operation (ii) in which the first drive electrodes on all lines of the individual electrodes in the first direction are turned on or off in accordance with the image data under a state where the second drive electrodes on one line of the individual electrodes in the second direction are turned on and the second drive electrodes on all remaining lines of the individual electrodes in the second direction are turned off while sequentially changing the second drive electrodes on the line of the individual electrodes in the second direction that are turned on.

6. An electrostatic ejection type ink jet head that uses ink containing a charged fine particle component, controls ejection/non-ejection of the ink by means of an electrostatic force by applying a predetermined voltage to a plurality of individual electrodes arranged in a two-dimensional manner with reference to a first direction and a second direction in accordance with image data, and records an image corresponding to the image data on a recording medium, the electrostatic ejection type ink jet head comprising:

a head substrate;

first drive electrodes and second drive electrodes each provided for each of the individual electrodes to form a two-layered electrode structure;

ink guides arranged on the head substrate for each of the individual electrodes; and an insulating substrate in which through holes are established for each of the individual electrodes at a position corresponding to an arrangement of the ink guide, wherein the head substrate and the insulating substrate are arranged with a predetermined space therebetween, a flow path of the ink is formed between the head substrate and the insulating substrate, the ink guides are passed through the through holes established in the insulating substrate, tip portion of the ink guides are protruded above a surface of the insulating substrate on a recording medium side, the first drive electrodes are arranged closer to the insulating substrate than the flow path of the ink, the second drive electrodes are arranged closer to the head substrate side than the first drive electrodes, the first drive electrodes on each line of the plurality of individual electrodes arranged in the first direction are connected mutually, and the second drive electrodes on each line of the plurality of individual electrodes arranged in the second direction are connected mutually, and ejection/non-ejection of the ink at the time of recording of the image is controlled by sequentially repeating one of an operation (i) in which the second drive electrodes on all lines of the individual electrodes in the second direction are turned on or off in accordance with the image data under a state where the first drive electrodes on one line of the individual electrodes in the first direction are turned on and the first drive electrodes on all remaining lines of the individual electrodes in the first direction are turned off while sequentially changing the first drive electrodes on the line of the individual electrodes in the first direction that are turned on, and an operation (ii) in which the first drive electrodes on all lines of the individual electrodes in the first direction are turned on or off in accordance with the image data under a state where the second drive electrodes on one line of the individual electrodes in the second direction are turned on and the second drive electrodes on all remaining lines of the individual electrodes in the second direction are turned off while sequentially changing the second drive electrodes on the line of the individual electrodes in the second direction that are turned on, with the operation (i) being performed under a state where the individual electrodes are arranged so that the number of lines of the individual electrodes in the second direction is larger than the number of lines thereof in the first direction and the operation (ii) being performed under a state where the individual electrodes are arranged so that the number of lines in the first direction is larger than a number of lines in the second direction.

7. The electrostatic ejection type ink jet head according to claim 6, wherein the ejection/non-ejection of the ink at the time of recording of the image is controlled by sequentially repeating one of an operation (i) in which the second drive electrodes on all lines of the individual electrodes in the second direction are set to a high voltage level or a ground level in accordance with the image data under a state where the first drive electrodes on one line of the individual electrodes in the first direction are set under a high-impedance state and the first drive electrodes on all remaining lines of the individual electrodes in the first direction are set to a ground level while sequentially changing the first drive electrodes on the line of the individual electrodes in the first direction that are set under the high-impedance state, and an operation (ii) in which the first drive electrodes on all lines of the individual electrodes in the first direction are set to a high-voltage level or the ground level in accordance with the image data under a state where the second drive electrodes on one line of the individual electrodes in the second direction are set under the high-impedance state and the second drive electrodes on all remaining lines of the individual electrodes in the second direction are set to the ground level while sequentially changing the second drive electrodes on the line of the individual electrodes in the second direction that are set under the high-impedance state.

8. The electrostatic ejection type ink jet head according to claim 6, further comprising:

guard electrodes that are provided between the lines of the first drive electrodes in the first direction and is biased to a predetermined certain voltage level at the time of recording of the image, wherein the ejection/non-ejection of the ink at the time of recording of the image is controlled by sequentially repeating one of an operation (i) in which the first drive electrodes on all lines of the individual electrodes in the first direction are set to a high voltage level or a ground level in accordance with the image data under a state where the second drive electrodes on one line of the individual electrodes in the second direction are set under a high-impedance state and the second drive electrodes on all remaining lines of the individual electrodes in the second direction are at a ground level while sequentially changing the second drive electrodes on the line of the individual electrodes in the second direction that are set under the high-impedance state, and an operation (ii) in which the first drive electrodes on all lines of the individual electrodes in the first direction are turned on or off in accordance with the image data under a state where the second drive electrodes on one line of the individual electrodes in the second direction are turned on and the second drive electrodes on all remaining lines of the individual electrodes in the second direction are turned off while sequentially changing the second drive electrodes on the line of the individual electrodes in the second direction that are turned on.

9. An electrostatic ejection type ink jet head that uses ink containing a charged fine particle component, controls ejection/non-ejection of the ink by means of an electrostatic force by applying a predetermined voltage to a plurality of individual electrodes arranged in a two-dimensional manner with reference to a first direction and a second direction in accordance with image data, and records an image corresponding to the image data on a recording medium, the electrostatic ejection type ink jet head comprising:

a head substrate;

first drive electrodes and second drive electrodes each provided for each of the individual electrodes to form a two-layered electrode structure;

ink guides arranged on the head substrate for each of the individual electrodes; and an insulating substrate in which through holes are established for each of the individual electrodes at a position corresponding to an arrangement of the ink guide, wherein the head substrate and the insulating substrate are arranged with a predetermined space therebetween, a flow path of the ink is formed between the head substrate and the insulating substrate, the ink guides are passed through the through holes established in the insulating substrate, tip portion of the ink guides are protruded above a surface of the insulating substrate on a recording medium side, the first drive electrodes are arranged closer to the insulating substrate than the flow path of the ink, the second drive electrodes are arranged closer to the head substrate side than the first drive electrodes, the first drive electrodes on each line of the plurality of individual electrodes arranged in the first direction are connected mutually, the second drive electrodes on the line of the plurality of individual electrodes arranged in the second direction are connected mutually, and the lines of the individual electrodes in the first direction are divided into a plurality of groups that each group contains at least one line, and ejection/non-ejection of the ink at the time of recording of the image is controlled by simultaneously for the plurality of groups and sequentially repeating one of an operation (i) in which the second drive electrodes on all lines of the individual electrodes in the second direction are turned on or off in accordance with the image data under a state where the first drive electrodes on one line of the individual electrodes in the first direction are turned on and the first drive electrodes on all remaining lines of the individual electrodes in the first direction are turned off while sequentially changing the first drive electrodes on the line of the individual electrodes in the first direction that are turned on, and an operation (ii) in which the first drive electrodes on all lines of the individual electrodes in the first direction are turned on or off in accordance with the image data under a state where the second drive electrodes on one line of the individual electrodes in the second direction are turned on and the second drive electrodes on all remaining lines of the individual electrodes in the second direction are turned off while sequentially changing the second drive electrodes on the line of the individual electrodes in the second direction that are turned on.

10. The electrostatic ejection type ink jet head according to claim 9, wherein the ejection/non-ejection of the ink at the time of recording of the image is controlled by sequentially repeating one of an operation (i) in which the second drive electrodes on all lines of the individual electrodes in the second direction are set to a high voltage level or a ground level in accordance with the image data under a state where the first drive electrodes on one line of the individual electrodes in the first direction are set under a high-impedance state and the first drive electrodes on all remaining lines of the individual electrodes in the first direction are set to a ground level while sequentially changing the first drive electrodes on the line of the individual electrodes in the first direction that are set under the high-impedance state, and an operation (ii) in which the first drive electrodes on all lines of the individual electrodes in the first direction are set to a high-voltage level or the ground level in accordance with the image data under a state where the second drive electrodes on one line of the individual electrodes in the second direction are set under the high-impedance state and the second drive electrodes on all remaining lines of the individual electrodes in the second direction are set to the ground level while sequentially changing the second drive electrodes on the line of the individual electrodes in the second direction that are set under the high-impedance state.

11. The electrostatic ejection type ink jet head according to claim 9, further comprising:

guard electrodes that are provided between the lines of the first drive electrodes in the first direction and is biased to a predetermined certain voltage level at the time of recording of the image, wherein the ejection/non-ejection of the ink at the time of recording of the image is controlled by sequentially repeating one of an operation (i) in which the first drive electrodes on all lines of the individual electrodes in the first direction are set to a high voltage level or a ground level in accordance with the image data under a state where the second drive electrodes on one line of the individual electrodes in the second direction are set under a high-impedance state and the second drive electrodes on all remaining lines of the individual electrodes in the second direction are at a ground level while sequentially changing the second drive electrodes on the line of the individual electrodes in the second direction that are set under the high-impedance state, and an operation (ii) in which the first drive electrodes on all lines of the individual electrodes in the first direction are turned on or off in accordance with the image data under a state where the second drive electrodes on one line of the individual electrodes in the second direction are turned on and the second drive electrodes on all remaining lines of the individual electrodes in the second direction are turned off while sequentially changing the second drive electrodes on the line of the individual electrodes in the second direction that are turned on.

12. An electrostatic ejection type ink jet head that performs recording by ejecting ink containing charged fine particles by means of an electrostatic force, comprising:

a head substrate;

an insulating substrate arranged so as to be spaced from the head substrate by a certain distance and forms an ink flow path in a space with the head substrate;

an ink guide arranged on the head substrate so that tip portion thereof protrudes from a through hole established in the insulating substrate, and guides the ink flowing through the ink flow path from the ink flow path to the tip portion;

a drive electrode provided for a part of an inner wall of the ink flow path side of the insulating substrate in proximity to the ink guide so as to surround a periphery of the ink guide, and is used to eject the ink guided to the tip portion of the ink guide by means of the electrostatic force; and a coating film coating the drive electrode and smoothing the inner wall of the ink flow path side.

13. An electrostatic ejection type ink jet head according to claim 12, wherein on a surface of the insulating substrate on an opposite side to the inner wall of the ink flow path side, another drive electrode used in combination with the drive electrode to eject the ink by means of the electrostatic force is provided in proximity to the ink guide so as to surround the periphery of the ink guide.

14. An electrostatic ejection type ink jet head according to claim 13, wherein a plurality of sets of the ink guide, the through hole, the drive electrode, and the other drive electrode are arranged in a two-dimensional manner along a first direction and a second direction that is orthogonal to the first direction, wherein the drive electrodes of the plurality of sets are connected to each other through wiring along the first direction, and the other drive electrodes of the plurality of sets are connected to each other through wiring along the second direction.

* * * * *